US012808203B2

(12) United States Patent
Landgård et al.

(10) Patent No.: US 12,808,203 B2
(45) Date of Patent: Nov. 24, 2026

(54) FLOOR PANEL ASSEMBLY AND ASSOCIATED CONNECTING DEVICE

(71) Applicant: Välinge Innovation AB, Viken (SE)

(72) Inventors: Caroline Landgård, Lerberget (SE); Robin Mellby, Påarp (SE); Fredrik Boo, Kågeröd (SE); Rickard Rittinge, Förslöv (SE); Christian Boo, Kågeröd (SE); Karl Quist, Höganäs (SE)

(73) Assignee: VÄLINGE INNOVATION AB, Viken (SE)

( * ) Notice: Subject to any disclaimer, the term of this patent is extended or adjusted under 35 U.S.C. 154(b) by 820 days.

(21) Appl. No.: 18/063,827

(22) Filed: Dec. 9, 2022

(65) Prior Publication Data

US 2023/0258002 A1 Aug. 17, 2023

(30) Foreign Application Priority Data

Jan. 27, 2022 (SE) ..... 2250072-2
May 2, 2022 (SE) ..... 2250524-2

(51) Int. Cl.
*E04F 15/02* (2006.01)

(52) U.S. Cl.
CPC .. *E04F 15/02038* (2013.01); *E04F 15/02022* (2013.01); *E04F 2201/0146* (2013.01);
(Continued)

(58) Field of Classification Search
CPC ..... E04F 15/02038; E04F 15/02022; E04F 2201/0146; E04F 2201/0153;
(Continued)

(56) References Cited

U.S. PATENT DOCUMENTS 7,841,144 B2 * 11/2010 Pervan ..... F16B 5/0016 52/391
10,280,627 B2 * 5/2019 De Rick ..... E04F 15/02038
(Continued)

FOREIGN PATENT DOCUMENTS

CN 105658883 A 6/2016
DE 20200268 U1 3/2002
(Continued)

OTHER PUBLICATIONS

International Search Report and Written Opinion received for PCT Patent Application No. PCT/SE2022/051163, mailed on Jan. 26, 2023, 14 pages.
(Continued)

*Primary Examiner* — Jessie T Fonseca
(74) *Attorney, Agent, or Firm* — Boone IP Law

(57) ABSTRACT

A floor panel assembly including a first and a second panel. A first edge portion of the first panel includes an upwardly extending locking element and a second edge portion of the second panel includes a downwardly open locking groove configured to cooperate with the locking element for horizontally locking the first and second edge portions to each other. The floor panel assembly further includes a connecting device configured to be at least partially arranged in the locking groove in a locked state of the first and second edge portions. The connecting device includes a positioning member configured to extend along a third edge portion of the first panel in the locked state, wherein the first and third edge portions join each other at a corner portion of the first panel. Also, a corresponding connecting device.

21 Claims, 11 Drawing Sheets

(52) U.S. Cl.
CPC ... *E04F 2201/0153* (2013.01); *E04F 2201/02* (2013.01); *E04F 2201/049* (2013.01); *E04F 2201/0505* (2013.01); *E04F 2201/0511* (2013.01); *E04F 2201/0523* (2013.01); *E04F 2201/0547* (2013.01)

(58) Field of Classification Search
CPC ..... E04F 2201/0505; E04F 2201/0511; E04F 2201/0523; E04F 2201/0547
See application file for complete search history.

(56) References Cited

U.S. PATENT DOCUMENTS

| | | | | |
|---|---|---|---|---|
| 2005/0055972 | A1* | 3/2005 | Luty | E04C 3/28 52/741.1 |
| 2006/0144011 | A1* | 7/2006 | Symington | E04F 21/1838 52/782.1 |
| 2008/0104921 | A1* | 5/2008 | Pervan | E04F 15/107 52/588.1 |
| 2008/0134614 | A1* | 6/2008 | Pervan | E04F 21/22 52/391 |
| 2009/0249730 | A1* | 10/2009 | Vibiano | E04F 15/02 52/586.2 |
| 2011/0131916 | A1* | 6/2011 | Chen | E04F 15/02 52/582.1 |
| 2017/0051513 | A1 | 2/2017 | Almandoz | |
| 2017/0234020 | A1* | 8/2017 | Pervan | E04F 15/04 52/582.2 |
| 2021/0310256 | A1* | 10/2021 | Boo | E04F 13/0894 |
| 2021/0381251 | A1* | 12/2021 | Svensson | E04F 13/0894 |
| 2022/0243482 | A1* | 8/2022 | Landgård | B32B 21/13 |
| 2023/0383542 | A1* | 11/2023 | Quist | E04F 13/0894 |

FOREIGN PATENT DOCUMENTS

| | | | | |
|---|---|---|---|---|
| DE | 20211263 | U1 | 12/2002 | |
| DE | 202011103629 | U1 | 3/2012 | |
| DE | 102017110878 | A1 * | 11/2018 | E04F 15/02038 |
| EP | 1420125 | A2 * | 5/2004 | E04F 15/02 |
| EP | 1978179 | A1 * | 10/2008 | E04F 15/02 |
| EP | 2270291 | A1 * | 1/2011 | E04F 15/02 |
| EP | 3219868 | A1 | 9/2017 | |
| EP | 3309324 | A1 * | 4/2018 | E04F 15/02038 |
| WO | 2006/043893 | A1 | 4/2006 | |
| WO | WO-2014108129 | A1 * | 7/2014 | E04F 15/02038 |
| WO | WO-2018211054 | A1 * | 11/2018 | E04F 15/02038 |
| WO | 2023/131873 | A1 | 7/2023 | |

OTHER PUBLICATIONS

Office Action received for Swedish Patent Application No. 2250072.2, mailed on Jul. 6, 2022, 9 pages.
U.S. Appl. No. 18/675,438, filed May 28, 2024, Karl Quist.
Extended European Search Report issued by the European Patent Office, on Dec. 19, 2025 in European Patent Application 22924415.7, 9 pages.
First Office Action issued by Chinese Patent Office for Application No. 202280089712.8, dated Sep. 5, 2026 with English translation, 12 pages.

* cited by examiner

D-D

E-E

F-F

G-G

E-E, G-G

F-F

D'-D'

E'-E'

D-D

E-E, G-G

FLOOR PANEL ASSEMBLY AND ASSOCIATED CONNECTING DEVICE

CROSS REFERENCE TO RELATED APPLICATIONS

The present application claims the benefit of Swedish Application No. 2250072-2, filed on Jan. 27, 2022, and the benefit of Swedish Application No. 2250524-2, filed on May 2, 2022. The entire contents of each of Swedish Application No. 2250524-2 and Swedish Application No. 2250072-2 are hereby incorporated herein by reference in their entirety.

TECHNICAL FIELD

The disclosure generally relates to a floor panel assembly comprising a connecting device. The connecting device is configured to position at least two adjacent panels, such as three or four adjacent panels, in the floor panel assembly with respect to each other. The disclosure also relates to the connecting device itself and to a corresponding wall panel assembly.

BACKGROUND

Floor panels are often assembled to each other in an offset manner such that, say, the short edges in neighbouring rows become displaced with respect to each other. Thereby, the short edges and the long edges of the panels may be assembled such that a three-way junction (T-crossing) is formed.

There may be scenarios in which the floor panels are assembled to each other such that the short and long edges of the panels come into alignment, such that a four-way junction (X-crossing) is formed at their corner sections. For example, this may be the case when a particular floor design is desired, such as when the floor covering is adapted to resemble ceramic tiles.

However, a displacement of any of the floor panels in such a four-way junction, if ever so small, may give rise to pronounced visible gaps. Attempts to reduce this risk have been made, e.g., by using an adhesive element, such as glue or sticky tape, or by utilizing friction between the panels. Nevertheless, the known solutions remain largely unsatisfactory, for example since they are inaccurate and typically cumbersome. Hence, there is need for an improved assembly of such panels.

SUMMARY

It is therefore an object of at least certain embodiments of the present disclosure to provide a floor panel assembly in which a relative position between the panels may be more controlled.

Another object of at least certain embodiments of the present disclosure is to provide a floor panel assembly for which the panels may be more securely interlocked, preferably in a four-way junction.

An additional object of at least certain embodiments of the present disclosure is to provide a floor panel assembly that allows for a simpler and/or a more time efficient assembly of the panels therein.

It is also an object of at least certain embodiments of the present disclosure to provide a connecting device configured to provide a floor panel assembly in accordance with any of the objects above.

These and other objects and advantages that will be apparent from the description have been achieved by the various aspects, embodiments and examples described below.

In accordance with a first aspect of the disclosure, there is provided a floor panel assembly comprising a first panel and a second panel. A first edge portion of the first panel comprises a strip extending horizontally beyond an upper portion of the first edge portion, wherein the strip comprises an upwardly extending locking element, and a second edge portion of the second panel comprises a downwardly open locking groove configured to cooperate with the locking element for horizontally locking the first and second edge portions to each other. The floor panel assembly further comprises a connecting device configured to be at least partially arranged in the locking groove in a locked state of the first and second edge portions. The connecting device comprises a positioning member configured to extend along a third edge portion of the first panel in the locked state, wherein the first and third edge portions join each other at a corner portion of the first panel.

A horizontal position of the connecting device in a direction along the first and second edge portions may be restricted or even fixed, whereby the positioning member in accordance with the first aspect may position the first panel with respect to the second panel. Indeed, by means of the positioning member, a relative horizontal displacement of one of the first and second panels with respect to the other panel in a direction along the first and second edge portions may be counteracted, or even entirely prevented. Thereby, the risk of creating a visible gap between the first and second panels in the floor panel assembly may be reduced, or even avoided. This may be especially advantageous when assembling the panels in a four-way junction.

Furthermore, by means of the connecting device comprising the positioning member, panel assembly may be simpler and/or more time efficient.

A further advantage of using a connecting device, e.g., compared to using an adhesive element, is that it may be used multiple times.

Generally herein, cooperating elements (such as between elements of the panels, between elements of the connecting device and of a panel) may cooperate by direct or indirect engagement. In any embodiment described herein, there may be a sealing agent, such as a wax, silicone, a rubber strip or an adhesive, provided between the cooperating elements, thereby providing examples of an indirect engagement.

The positioning member may be further configured to extend along a third edge portion of the second panel in the locked state, wherein the second and third edge portions join each other at a corner portion of the second panel.

The positioning member may comprise an arm portion, preferably configured to extend in the locked state at least partially above an upwardly extending locking element of the third edge portion of the first panel and/or an upwardly extending locking element of a third edge portion of the second panel. The arm portion may vertically position the first and second panels with respect to each other.

An upwardly extending locking element of the third edge portion of the first panel and/or an upwardly extending locking element of the third edge portion of the second panel may extend vertically above the locking element of the first edge portion of the first panel. In some embodiments, the locking element of the first edge portion of the first panel may extend vertically above an upwardly extending locking element of the third edge portion of the first panel and/or an upwardly extending locking element of the third edge portion of the second panel. In any of these embodiments, the connecting device may be provided in a joint with improved moisture control, see WO 2021/058572 A1 whose contents, especially on page 8, lines 15-32, page 12, lines 12-30, FIGS. 4A-4B and FIGS. 7-8, hereby are expressly incorporated by reference.

A body portion of the connecting device may be configured to be arranged in the locking groove horizontally outward of the locking element of the first edge portion in the locked state. For example, the body portion may counteract, or even entirely prevent, a relative displacement of the first and second panels against each other.

A projection may be configured to extend from the body portion at least partially above the locking element of the first edge portion in the locked state. The projection may vertically position the connecting device with respect to the first panel.

By means of the arm portion and/or the projection, a risk of involuntarily displacing the connecting element under the panels may be reduced or even eliminated.

The connecting device may further comprise an aligning element configured to extend along a first edge portion of a third panel of the floor panel assembly in the locked state of the first and second edge portions of the first and second panels and in a locked state of the third edge portion of the first panel and a fourth edge portion of the third panel. The aligning element may horizontally align the third panel with respect to the first and/or the second panel.

The aligning element may be arranged, such as entirely, horizontally outward of the first edge portion of the third panel in the locked state of the first and second edge portions of the first and second panels and in the locked state of the third and fourth edge portions of the first and third panels. Thereby, the third panel may be horizontally aligned while admitting an assembly of the third edge portion of the first panel to the fourth edge portion of the third panel, such as by angling of the third panel relative to the first panel.

The aligning element may comprise a flange portion configured to be provided in a recess of the first edge portion of the third panel and/or in a second edge portion of a fourth panel in a locked state of a first edge portion of the third panel and a second edge portion of the fourth panel. Thereby, the aligning element may be reinforced.

The flange portion may extend from a lower portion of the aligning element and the recess may be provided in a rear side of the third and/or fourth panel.

The positioning member may comprise a lug portion configured to be provided in a recess of a fourth edge portion of a third panel and/or in a fourth edge portion of a fourth panel in a locked state of the third edge portion of the first panel and the fourth edge portion of the third panel and/or in a locked state of a third edge portion of the second panel and the fourth edge portion of the fourth panel.

The lug portion may extend from a lower portion of the positioning member and the recess may be provided in a rear side of the third and/or fourth panel.

The floor panel assembly may further comprise a tongue and a tongue groove for vertical locking of the first and second edge portions.

The tongue may be a separate tongue, such as a separately formed tongue.

The connecting device may comprise a polymer-based material, such as a thermoplastic material, e.g., a polylactic acid, PLA, or polypropylene, PP. Optionally, the polymer-based material may comprise a reinforcing filler, such as glass fibres. Other materials, such as a metal, e.g., aluminum, are also equally conceivable.

Any pair of first and second edge portions of a given pair of panels herein, in particular the first edge portion of the first panel and the second edge portion of the second panel, may be configured to be assembled to each other by a relative essentially vertical displacement of the pair of panels, such as the first and second panels, against each other, preferably by so-called vertical folding (scissor movement).

Likewise, any pair of third and fourth edge portions of a given pair of panels herein, in particular the third edge portion of the first panel and the fourth edge portion of the third panel, may be configured to be assembled to each other by angling of the pair of panels, such as the third and first panels, relative to each other.

A body portion and/or an aligning element of the connecting device may comprise a positioning protrusion configured to cooperate with at least one panel of the floor panel assembly. Alternatively, or additionally, the positioning member may comprise a positioning projection configured to cooperate with at least one panel of the floor panel assembly. By means of these embodiments, the positioning of the panels may become further improved. For example, the positioning protrusion and/or the positioning projection may couple the connecting device and the panels by friction. Moreover, a manufacturing of a locking device of the panels may be simplified, for example since increased dimensional tolerances thereof may be accepted.

The panels in the floor panel assembly may comprise a decorative joint portion along at least one, preferably all, of their edge portions. A horizontal and/or a vertical positioning may be particularly important for such panels for providing an aesthetically satisfactory assembly. For example, the panels may imitate ceramic tiles.

In accordance with a second aspect of the disclosure, a connecting device comprising a body portion, and a positioning member connected to the body portion, is provided, wherein a longitudinal extension of the positioning member and a longitudinal extension of the body portion are disposed essentially perpendicularly to each other. The body portion comprises a projection extending from the body portion and/or the positioning member comprises an arm portion extending from a base portion of the positioning member.

Embodiments and examples of the second aspect are largely analogous to those of the first aspect, whereby reference is made thereto. In addition, the following embodiments are conceivable.

The longitudinal extension of the positioning member may traverse both sides of the body portion.

The connecting device may further comprise an aligning element extending from the body portion and extending essentially in parallel with the longitudinal extension of the body portion.

The aligning element may comprise a flange portion, preferably extending from a lower portion thereof. Alternatively, or additionally, the positioning member may comprise a lug portion, preferably extending from a lower portion thereof.

The arm portion may be provided vertically above or below the projection.

The connecting device may further comprise a sealing member.

The body portion and/or an aligning element of the connecting device may comprise a positioning protrusion.

The positioning member may comprise a positioning projection.

In accordance with a third aspect of the disclosure, there is provided a wall panel assembly. Embodiments and examples of the third aspect are largely analogous to those of the first aspect, whereby reference is made thereto. It is stressed, however, that the floor panels are replaced by wall panels.

Aspects of the disclosure have mainly been described above with reference to a few embodiments. However, as is readily appreciated by a person skilled in the art, other embodiments than the ones disclosed above are equally possible within the scope of aspects of the disclosure.

Generally, all terms used in the claims below are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. Reference to one or a plurality of "at least one element", etc., may shortly be referred to as "the element(s)".

BRIEF DESCRIPTION OF THE DRAWINGS

The disclosure will in the following be described in connection to exemplary embodiments and in greater detail with reference to the appended exemplary drawings, wherein.

DETAILED DESCRIPTION

Figure 1A:
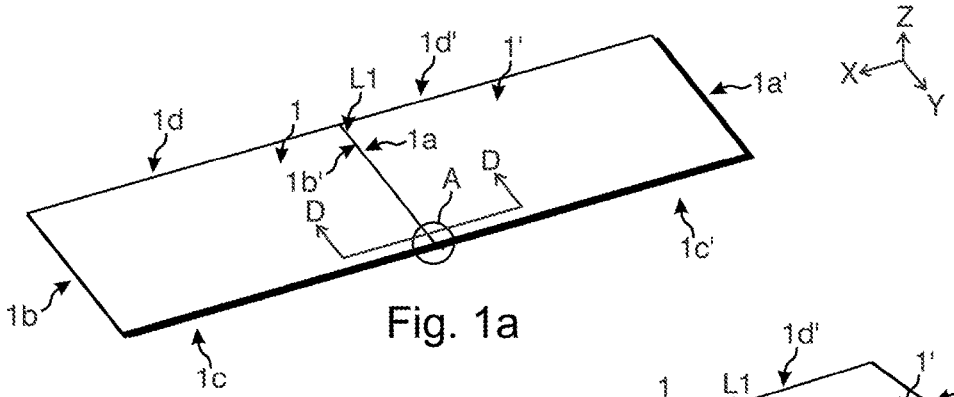
FIGS. 1*a*-1*d* illustrate embodiments of a floor panel assembly in perspective views (FIGS. 1*a*-1*b*) and in enlarged partial views around the sections A (FIG. 1*c*) and B (FIG. 1*d*) in FIGS. 1*a*-1*b*.
Figure 1B:
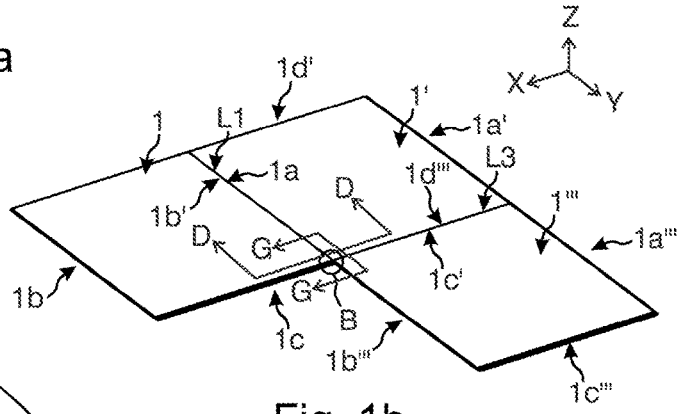
Figure 1C:
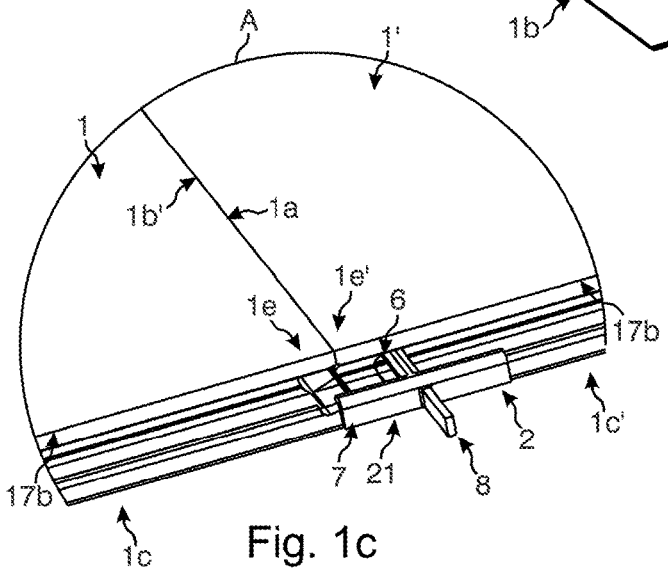
Figure 1D:
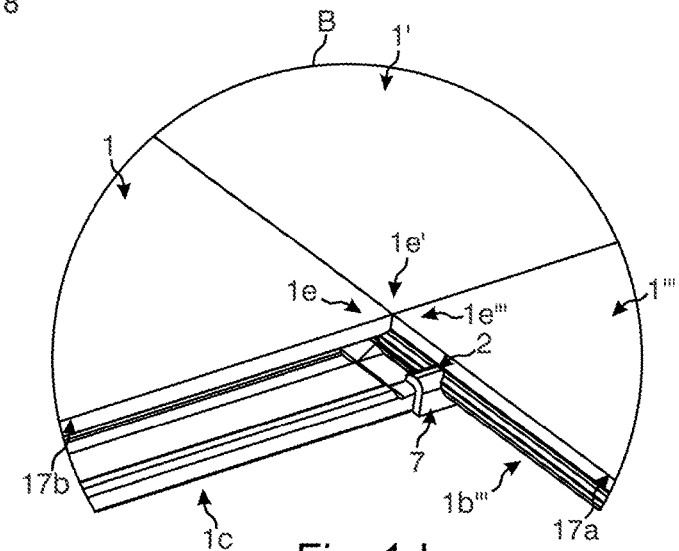

Next, various embodiments of a floor panel assembly will be described with reference to the embodiments in, e.g., FIGS. 1*a*-1*d*, 2*a*-2*c*, 3*a*-3*d*, 4*a*-4*e*, 5*a*-5*d*, 6*a*-6*d*, 7*a*-7*d*, 8*a*-8*d*, 9*a*-9*e*, 10*a*-10*h* and 11*a*-11*d*. The floor panel assembly comprises a first 1 and a second 1' panel and, preferably, a third 1" and/or a fourth 1" panel. Preferably, the panels 1, 1', 1", 1'" are substantially identical to each other. For example, the panels may imitate ceramic tiles. The floor panel assembly may provide a floor covering that may be floating on a subfloor 20, see, e.g., FIGS. 3*a*-3*d*. In some embodiments, however, it may be glued to the subfloor 20.

In non-restrictive examples, the floor panels described herein may be thermoplastic-based panels, thermosetting-based panels, ceramic tiles, or wood-based panels. By way of example, each panel may be a laminate panel, a wood powder-based panel, optionally comprising a veneer layer, a ceramic tile attached to a thermoplastic core, a mineral-based panel, such as comprising magnesium oxide and, optionally, magnesium chloride (e.g., $MgCl_2$) and/or magnesium sulfate (e.g., $MgSO_4$), a Luxury Vinyl Tile (LVT tile), a Stone Plastic (Polymer) Composite panel (SPC panel), or an Expanded Polymer Core panel (EPC panel), also known as Water Proof Core panel (WPC panel). Any of these panels may imitate ceramic tiles proper.

Each of the first 1, second 1', third 1" and fourth 1'" panels may comprise a first 1*a*, 1*a*', 1*a*'", 1*a*", a second 1*b*, 1*b*', 1*b*", 1*b*'", a third 1*c*, 1*c*', 1*c*", 1*c*'" and a fourth 1*d*, 1*d*', 1*d*", 1*d*'" edge portion. The first (third) and second (fourth) edge portions of each panel may be oppositely arranged to each other. For example, the third and fourth (first and second) edge portions may extend along a first (second) horizontal direction X (Y). A thickness direction of the panels may be parallel with a vertical direction Z. Preferably, the panels are rectangular. In a first example, the first (third) and second (fourth) edge portions are short (long) edge portions. In a second example, the first (third) and second (fourth) edge portions are long (short) edge portions. In some embodiments, however, the panels may be square.

The first 1*a* (second 1*b*''') and third 1*c* (fourth 1*d*'') edge portions may join each other at a corner portion 1*e* (1*e*'''') of the first panel 1 (fourth panel 1'''). The second 1*b*' (first 1*a*'') and third 1*c*' (fourth 1*d*'') edge portions join each other at a corner portion 1*e*' (1*e*'') of the second panel 1' (third panel 1''). The panels 1, 1', 1'', 1''' may be assembled to each other such that a four-way junction is formed at their corner portions 1*e*, 1*e*', 1*e*'', 1*e*'''. The sides 1*f* of the edge portions provided adjacent to front sides 1*g* of the panels 1, 1', 1'', 1''' may thereby form a cross, cf. FIGS. 2*c* and 4*d*-4*e*.

Each panel may comprise a mechanical locking device for horizontally and, preferably, vertically locking the panel to an adjacent panel. As shown in, e.g., FIGS. 3*a* and 4*d*-4*e* (FIGS. 3*c* and 4*d*-4*e*), the first 1*a* (1*a*'') and second 1*b*' (1*b*''') edge portions may be locked to each other to obtain a locked state L1 (L4). Moreover, as shown in, e.g., FIGS. 3*b* and 4*d*-4*e* (FIGS. 3*d* and 4*d*-4*e*), the third 1*c* (1*c*') and fourth 1*d*'' (1*d*''') edge portions may be locked to each other to obtain a locked state L2 (L3). The locked state L1 (L4) may include a horizontal and, optionally a vertical, locking of the first 1*a* (1*a*'') and second 1*b*' (1*b*''') edge portions to each other. The locked state L2 (L3) may include a horizontal and, optionally a vertical, locking of the third 1*c* (1*c*') and fourth 1*d*'' (1*d*''') edge portions to each other.

The corner portions 1*e*, 1*e*', 1*e*'', 1*e*'' may face each other in a locked state L1, L2, L3, L4 of all four panels 1, 1', 1'', 1''.

As shown in, e.g., FIGS. 2*c*, 3*a*, 7*c*, 8*a*, 8*c*, 9*d*, 11*a* and 11*c*, the first edge portion 1*a* comprises a strip 3 extending horizontally beyond an upper portion 4*a* thereof. The strip 3 comprises an upwardly extending locking element 5, preferably located at an outer portion of the strip 3. Moreover, the second edge portion 1*b*' comprises a downwardly open locking groove 6 configured to cooperate with the locking element 5 for horizontally locking the first 1*a* and second 1*b*' edge portions to each other. For example, the upper portions 4*a*, 4*b* as well as an inner surface 5*a* of the locking element 5 and an outer surface 6*a* of the locking groove 6 may cooperate for horizontal locking.

Optionally, the panels 1, 1' further comprise a tongue 11 and a tongue groove 12 for vertical locking of the first 1*a* and second 1*b*' edge portions. As shown in, e.g., FIG. 3*a*, the tongue 11 and tongue groove 12 may be provided in the first 1*a* and second 1*b*' edge portions, respectively. For example, the tongue 11 may be a separate tongue provided in a displacement groove 11*a*. However, providing the tongue 11 and tongue groove 12 in the second 1*b*' and first 1*a* edge portions, respectively, is equally conceivable. Such a tongue 11' and groove 12' configuration is preferred also in the first 1*a*'' and second 1*b*''' edge portions, see, e.g., FIGS. 3*c*, 5*d*, 6*d*, 7*b*, 11*a* and 11*c*. It is noted that for increasing the clarity the separate tongue is sometimes removed in the figures herein.

As shown in, e.g., FIGS. 2*c*, 3*b*, 7*d*, 8*b*, 8*d*, 9*e*, 11*b* and 11*d*, the third edge portion 1*c* comprises a strip 13 extending horizontally beyond an upper portion 14*a* thereof. The strip 13 comprises an upwardly extending locking element 9, preferably located at an outer portion of the strip 13. Moreover, the fourth edge portion 1*d*'' comprises a downwardly open locking groove 10 configured to cooperate with the locking element 9 for horizontally locking the third 1*c* and fourth 1*d*'' edge portions to each other. For example, the upper portions 14*a*, 14*b* as well as an inner surface 9*a* of the locking element 9 and an outer surface 10*a* of the locking groove 10 may cooperate for horizontal locking.

Optionally, the panels 1, 1'' further comprise a tongue 11*b* and a tongue groove 12*a* for vertical locking of the third 1*c* and fourth 1*d*'' edge portions. As shown in, e.g., FIG. 3*b*, the tongue 11*b* and tongue groove 12*a* may be provided in the fourth 1*d*'' and third 1*c* edge portions, respectively. For example, the tongue 11*b* may be integrally formed with the third panel 1'', such as being formed in a core 29 thereof. However, providing the tongue 11*b* and tongue groove 12*a* in the third 1*c* and fourth 1*d*'' edge portions, respectively, is equally conceivable. Such a tongue 11*b*' and groove 12*a*' configuration is preferred also in the third 1*c*' and fourth 1*d*'' edge portions, see, e.g., FIGS. 3*d*, 7*a*, 8*b*, 8*d*, 9*e*, 11*b* and 11*d*.

A similar mechanical locking device as those described on the edge portions 1*a*, 1*b*', 1*c*, 1*d*'' may be provided on the corresponding edge portions of the panels 1, 1', 1'', 1''. For example, as shown in, e.g., FIG. 3*c*, a locking element 5' provided in a strip 3' of the first edge portion 1*a*'' may be configured to cooperate with a downwardly open locking groove 6' in the second edge portion 1*b*''' for horizontally locking the first 1*a*'' and second 1*b*''' edge portions to each other. The elements 4*a*', 4*b*', 11', 11*a*', 12' may be embodied identically to the elements 4*a*, 4*b*, 11, 11*a*, 12 described elsewhere herein, whereby reference is made thereto. Moreover, a locking element 9' provided in a strip 13' of the third edge portion 1*c*' may be configured to cooperate with a downwardly open locking groove 10' in the fourth edge portion 1*d*''' for horizontally locking the third 1*c*' and fourth 1*d*''' edge portions to each other, see, e.g., FIG. 3*d*. The elements 3', 4*a*', 4*b*', 5', 5*c*', 9', 11', 11*a*', 11*b*', 12', 12*a*', 13', 14*a*', 14*b*', etc., e.g., as shown in FIGS. 3*c*-3*d*, may be embodied identically to the elements 3, 4*a*, 4*b*, 5, 5*c*, 9, 11, 11*a*, 11*b*, 12, 12*a*, 13, 14*a*, 14*b*, etc., described elsewhere herein, whereby reference is made thereto.

The first 1*a* (1*a*'') and second 1*b*' (1*b*''') edge portions may be configured to be assembled to each other by a relative essentially vertical displacement of the first 1 (third 1'') and second 1' (fourth 1''') panels against each other, see page 16, line 30 to page 17, line 11 and FIGS. 2a-2e and 5a-5b of WO 2006/043893, whose content hereby is incorporated by reference. Alternatively, or preferably additionally, the third 1*c* (1*c*') and the fourth 1*d*'' (1*d*''') edge portions may be configured to be assembled to each other by angling of the third 1'' (second 1') and first 1 (fourth 1''') panels relative to each other.

The floor panel assembly further comprises a connecting device 2 configured to be at least partially arranged in the locking groove 6 in the locked state L1, cf., e.g., FIGS. 3*a*, 4*a*-4*c*, 8*a*, 8*c*, 9*d*, 11*a* and 11*c*. The connecting device 2 comprises a positioning member 7 configured to extend along the third edge portion 1*c* in the locked state L1. For example, the connecting device 2 may comprise a polymer-based material, such as PLA, or a metal, e.g., aluminum.

Figure 3A:
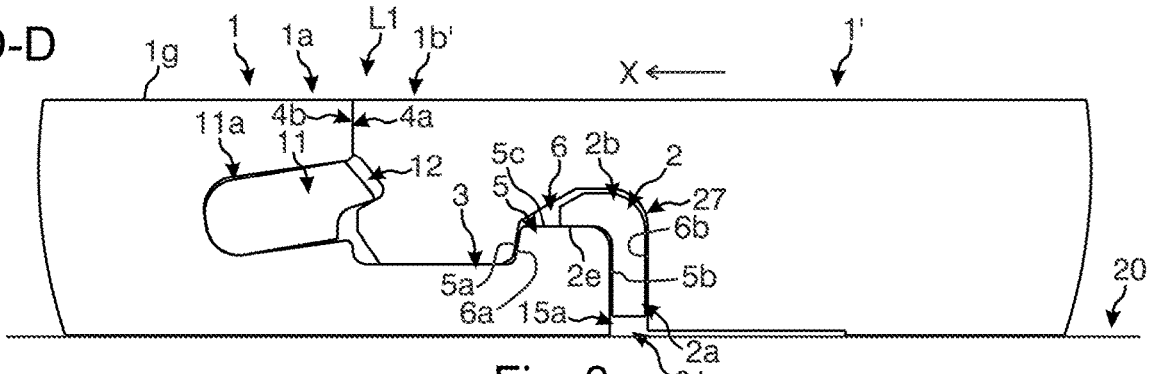
FIGS. 3*a*-3*b* illustrate embodiments of panels in locked states L1 (FIG. 3*a*) and L2 (FIG. 3*b*) along the cross-sectional side views D-D and E-E in any of FIGS. 1*a*-1*b*, 2*a* and 4*d*-4*e*.
Figure 3B:
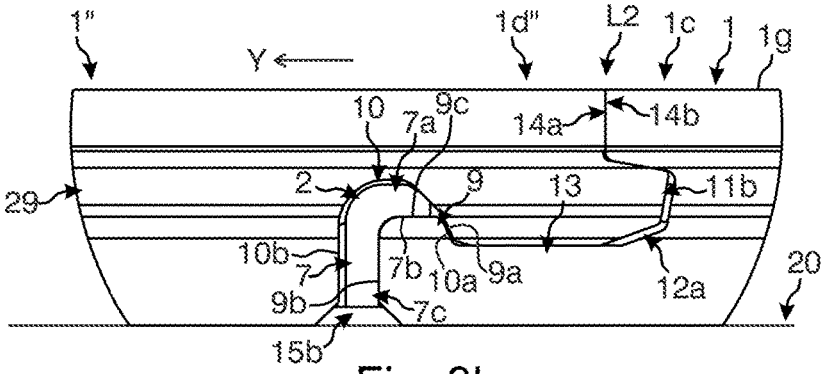
Figure 3C:
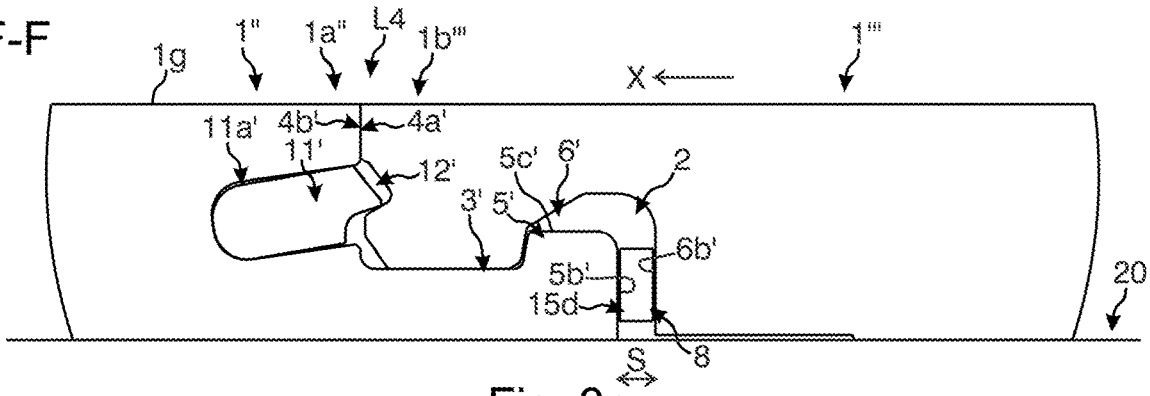
FIGS. 3*c*-3*d* illustrate embodiments of panels in locked states L3 (FIG. 3*d*) and L4 (FIG. 3*c*) along the cross-sectional side views F-F and G-G in any of FIGS. 1*a*-1*b*, 2*a* and 4*d*-4*e*.
Figure 3D:
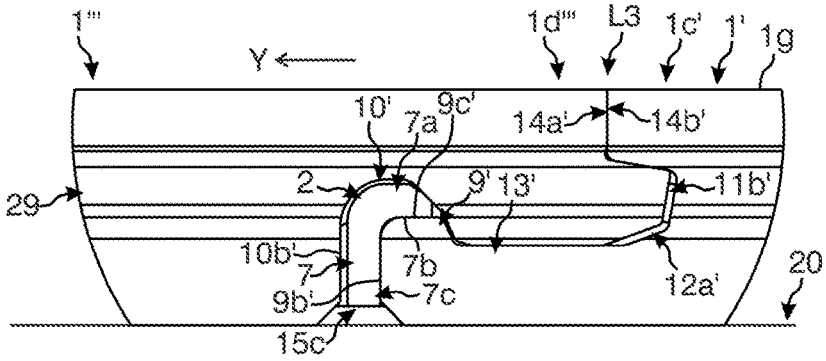

The connecting device 2 may comprise a body portion 2*a* configured to be arranged in the locking groove 6, preferably entirely, horizontally outward of the locking element 5 in the locked state L1, see, e.g., FIG. 3*a*. The body portion may be provided in a gap 15*a* between a section of the first edge portion 1*a* and a section of the second edge portion 1*b*'. Moreover, in the locked state L1, a base portion 7*c* of the positioning member 7 may extend, preferably entirely, horizontally outward of an upwardly extending locking element 9 provided on the strip 13 of the third edge portion 1*c*, cf. FIG. 3*b*. The positioning member may be provided in a gap 15*b* between a section of the third edge portion 1*c* and a section of the fourth edge portion 1*d*''. The positioning member 7 may be connected to the body portion 2*a*, and longitudinal extensions LP, LB of the positioning member 7 and the body portion 2*a* may be disposed essentially perpendicularly to each other, see, e.g., FIGS. 4*a*-4*c*, 5*c*, 6*a*-6*b*, 9*a*-9*c* and 10*a*-10*h*.

As shown in, e.g., FIGS. 1*c*, 2*b*, 4*a*, 4*b* (including the leftmost broken lines), 4*c*, 5*c*, 6*a*-6*b*, 9*a*-9*c* and 10*a*-10*h*, the positioning member 7 may be further configured to extend along the third edge portion 1*c*' in the locked state L1. Thus, the positioning member may be further provided in a gap 15*c* between a section of the third edge portion 1*c*' and a section of the fourth edge portion 1*d*'", see, e.g., FIG. 3*d*. The longitudinal extension LP of the positioning member 7 may thereby traverse both sides 2*c*, 2*d* of the body portion 2*a*. Hence, the positioning member may comprise a first 7*d* and a second 7*e* positioning portion extending on either side of the body portion 2*a* along the longitudinal extension LP. In the locked state L1, the base portion 7*c* may extend, preferably entirely, horizontally outward of the locking element 9'. Preferably, the positioning member 7 is provided along the third edge portion 1*c*' such that it extends horizontally inwardly (along the first direction X) of the locking groove 6 with respect to the second panel 1', cf. FIGS. 1*c* and 2*b*.

In the locked state L1, the body portion 2*a*, such as a side 2*c* thereof, may engage with the locking element 5, such as with an outer surface 5*b* thereof, see, e.g., FIG. 3*a*. Alternatively, or additionally, the body portion 2*a*, such as a side 2*d* thereof, may engage with the locking groove 6, such as with an inner surface 6*b* thereof. The body portion may be straight, such as comprising planar sides 2*c*, 2*d*. In the locked state L1, the base portion 7*c*, such as a side 7*f* thereof, may engage with the locking element 9 and/or the locking element 9', such as with an outer surface 9*b* and/or 9*b*' thereof, see, e.g., FIGS. 3*b* and 3*d*. Alternatively, or additionally, the base portion 7*c*, such as a side 7*g* thereof, may engage with the locking groove 10 and/or the locking groove 10', such as with an inner surface 10*b* and/or 10*b*' thereof. The base portion may be straight, such as comprising planar sides 7*f*, 7*g*.

Figure 4A:
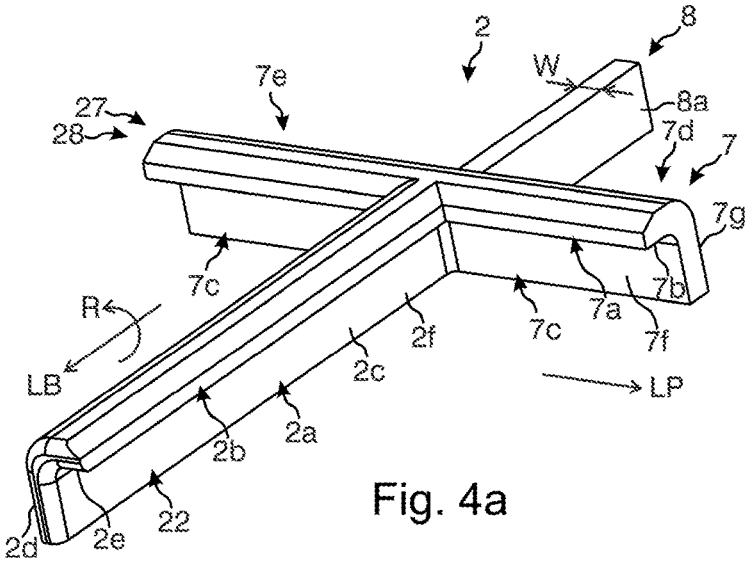
FIGS. 4*a*-4*e* illustrate in perspective views embodiments of a connecting device (FIGS. 4*a*-4*c*) and schematic illustrations of embodiments of assembled panels in top views (FIGS. 4*d*-4*e*).
Figure 4B:
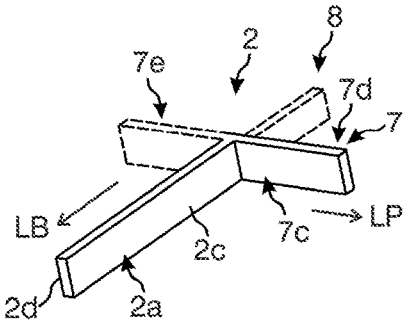
Figure 4C:
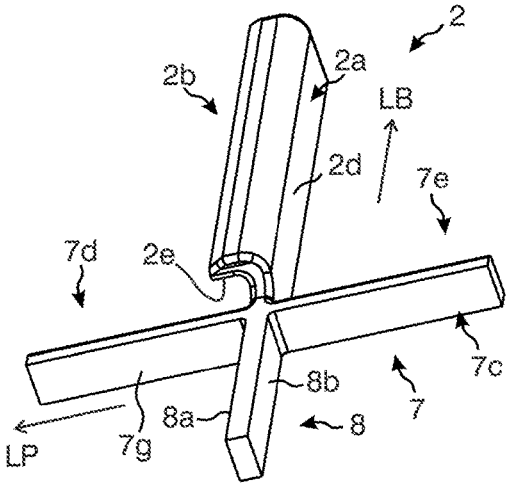

Hence, the connecting device 2 may be substantially L-shaped (see, e.g., the unbroken lines in FIG. 4*b*), T-shaped (see, e.g., the unbroken lines and the leftmost broken lines in FIG. 4*b*) or cross-shaped (see, e.g., FIGS. 4*a*, 4*c*, 5*c*, 6*a*-6*b*, 9*a*-9*c*, 10*a*-10*h* and the unbroken and all broken lines in FIG. 4*b*).

The connecting device 2 may extend substantially to the subfloor 20, e.g., such that at least a part of it contacts the subfloor 20. In some embodiments, however, and as shown in, e.g., FIGS. 1*c*, 2*b* and 3*a*, there may be a gap 21 between the subfloor 20 and one or several of the body portion 2*a*, the base portion 7*c* and the aligning element 8 (defined below).

In some embodiments, and as shown in, e.g., FIGS. 4*a*, 4*c*, 5*c*, 6*a*-6*b*, 9*a*-9*c* and 10*a*-10*c*, the connecting device 2 may comprise a projection 2*b* configured to extend from the body portion 2*a* at least partially above the locking element 5 in the locked state L1, see, e.g., FIG. 3*a*. The projection 2*b* may extend, preferably horizontally, from the body portion 2*a*. The projection 2*b*, such as an underside 2*e* thereof, may engage with the locking element 5, such as with an upper surface 5*c* thereof.

Alternatively, or additionally, the positioning member 7 may comprise an arm portion 7*a* configured to extend in the locked state L1 at least partially above the locking element 9 of the third edge portion 1*c* and/or the locking element 9' of the third edge portion 1*c*', see, e.g., FIGS. 3*b*, 3*d*, 4*a*, 4*c*, 5*c*, 6*a*-6*b*, 7*a* and 7*d*. The arm portion 7*a* may extend, preferably horizontally, from the base portion 7*c*. The arm portion 7*a*, such as an underside 7*b* thereof, may engage with the locking element 9 and/or the locking element 9', such as with an upper surface 9*c* and/or 9*c*' thereof.

Figure 2A:
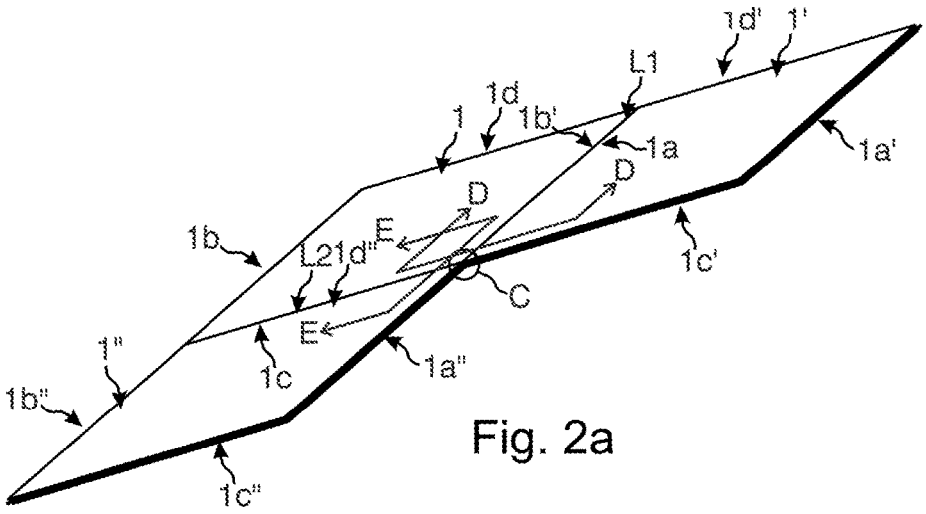
FIGS. 2*a*-2*c* illustrate an embodiment of a floor panel assembly in a perspective view (FIG. 2*a*) and in an enlarged partial view around the section C (FIG. 2*b*) in FIG. 2*a*, and an embodiment of a panel around a corner portion (FIG. 2*c*).
Figure 2B:
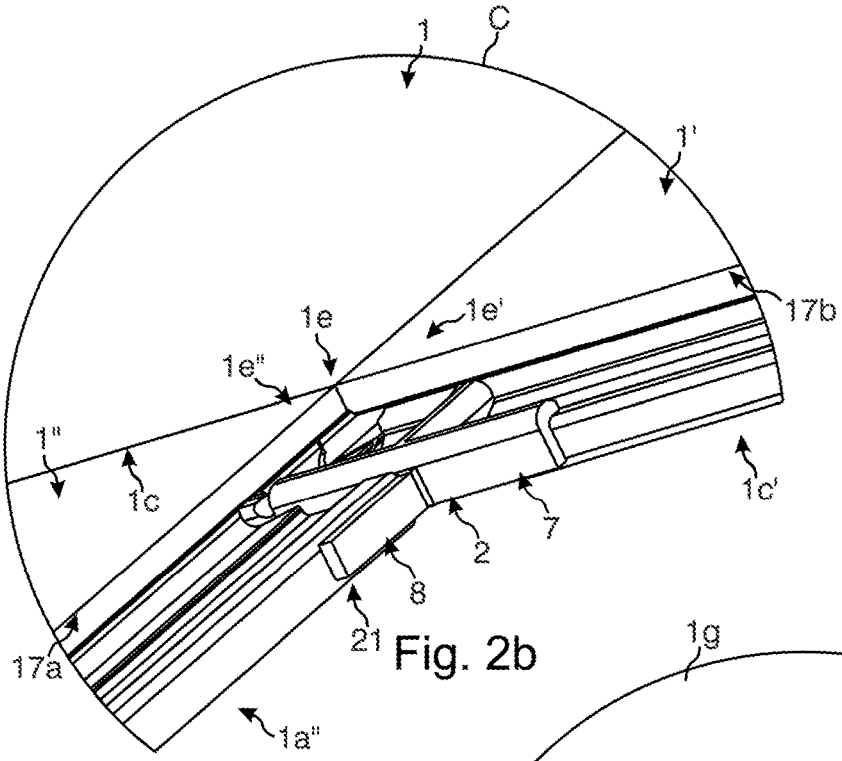
Figure 2C:
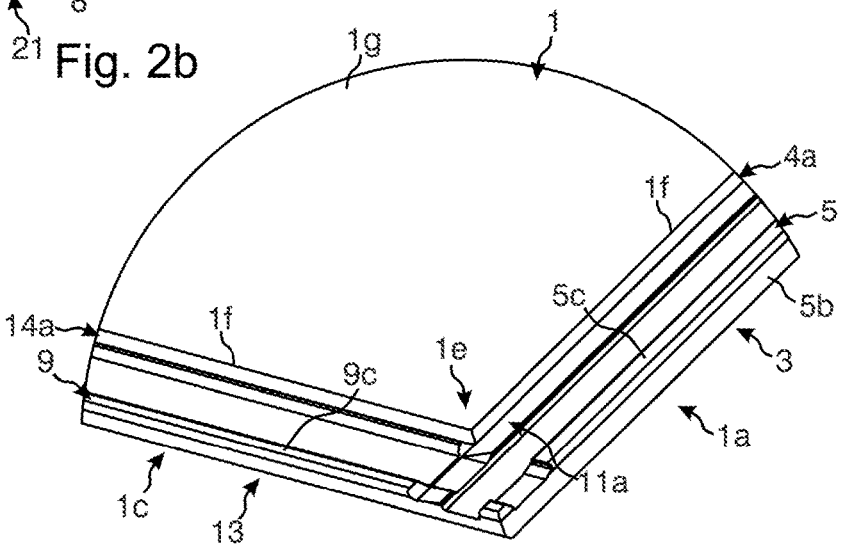
Figure 5A:
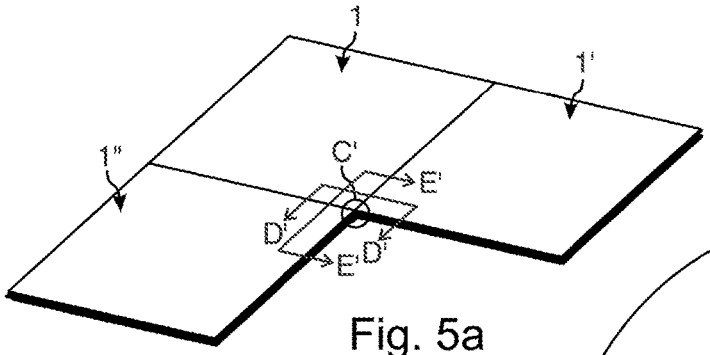
FIGS. 5*a*-5*d* illustrate embodiments of a floor panel assembly in a perspective view (FIG. 5*a*) and in a partial view around the section C' (FIG. 5*b*) in FIG. 5*a*, an embodiment of a connecting device in a perspective view (FIG. 5*c*), and an embodiment of panels in a locked state L4 (FIG. 5*d*) with the connecting device in FIG. 5*c* along the cross-sectional side views F-F in FIG. 4*d* or 4*e*.
Figure 5B:
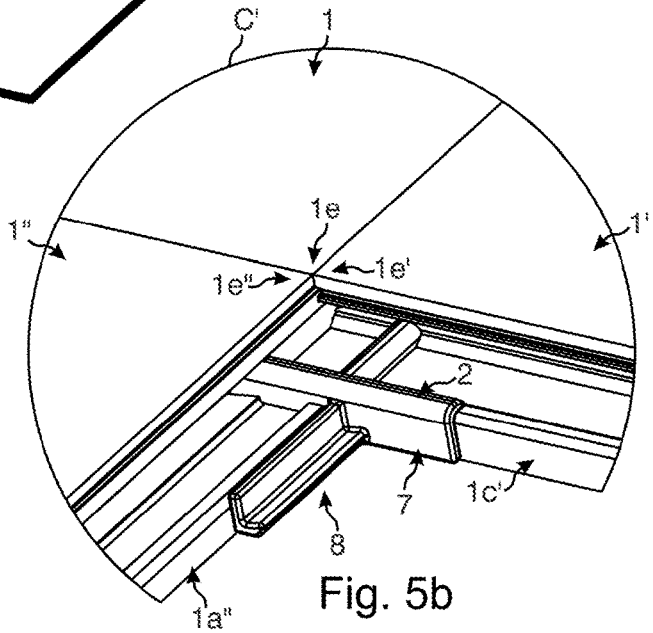
Figure 5D:
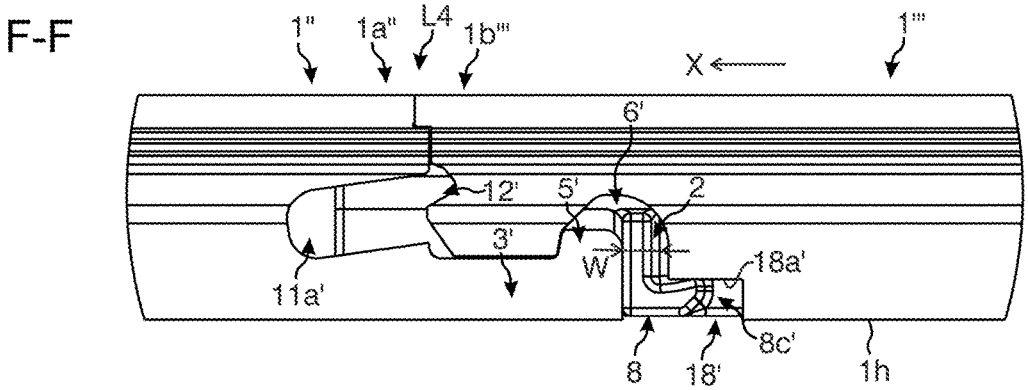
Figure 6A:
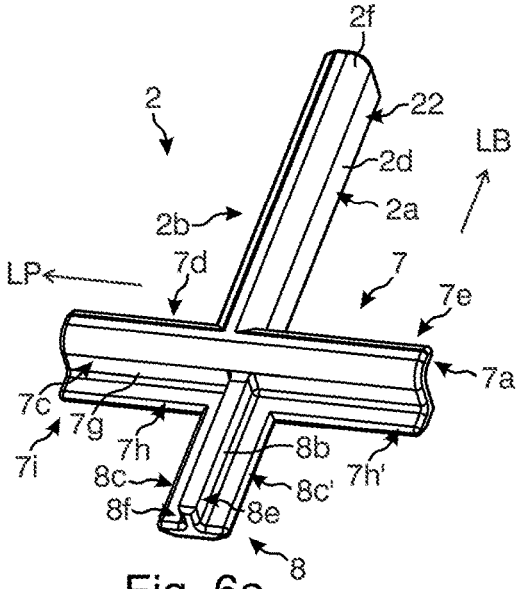
FIGS. 6*a*-6*d* illustrate in perspective views embodiments of a connecting device (FIGS. 6*a*-6*b*), and an embodiment of a floor panel assembly comprising this connecting device in a bottom view (FIG. 6*c*), and in a locked state L4 along the cross-sectional side view F-F (FIG. 6*d*) in FIG. 4*d* or 4*e*.
Figure 6B:
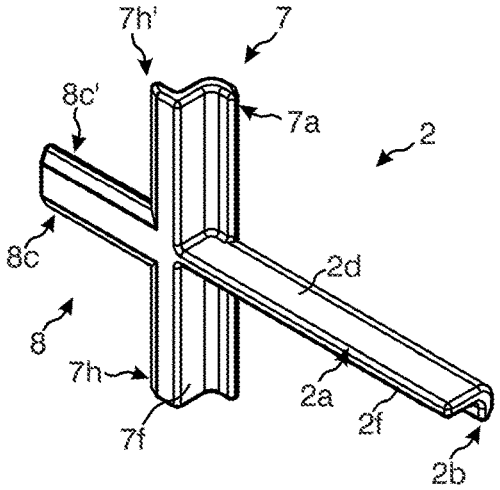
Figure 6C:
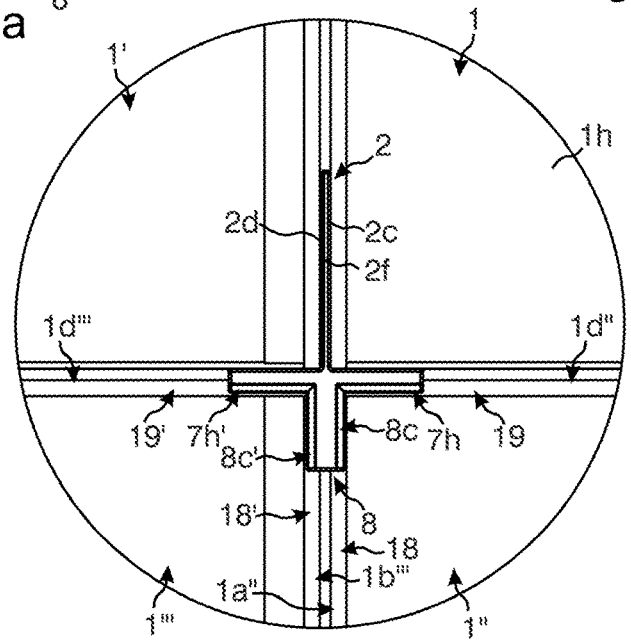
Figure 6D:
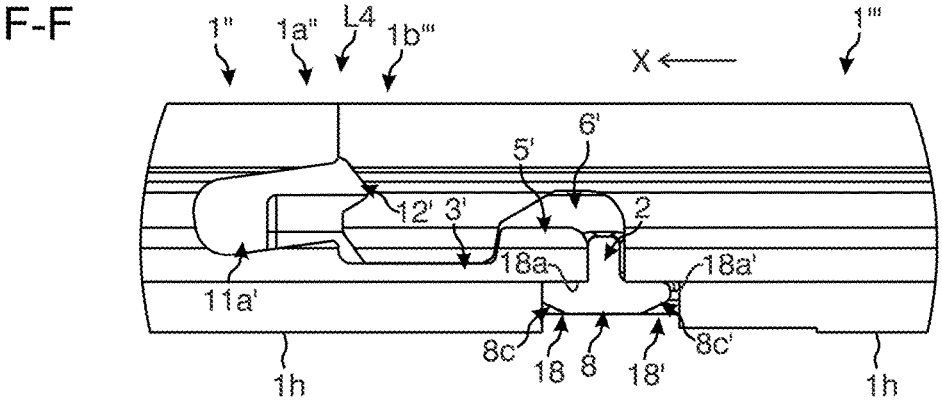

In some embodiments, and as shown in, e.g., FIGS. 4*a*, 4*b* (the upmost broken lines), 4*c*, 5*c*, 6*a*-6*b*, 9*a*-9*c* and 10*a*-10*h*, the connecting device 2 may further comprise an aligning element 8 configured to extend along a first edge portion 1*a*" of the third panel 1" in the locked states L1 and L2, see, e.g., FIGS. 2*b*, 5*b* and 6*c*. The aligning element 8 may be provided in a gap 15*d* between a section of the first edge portion 1*a*" and a section of the second edge portion 1*b*'", see, e.g., FIGS. 3*c*, 5*d*, 6*d*, 7*b*, 11*a* and 11*c*. In the locked states L1 and L2, the aligning element 8 may be arranged, preferably entirely, horizontally outward of the first edge portion 1*a*". The aligning element 8 may extend from the body portion 2*a* essentially in parallel with the longitudinal extension LB.

In the locked state L4, the aligning element 8 may be arranged in the locking groove 6', preferably at least partially arranged between the locking element 5' and an inner surface 6*b*' of the locking groove 6', cf. FIG. 3*c*. In the locked states L1 and L2, the aligning element 8, such as a wall 8*a* thereof, may engage with the locking element 5', such as with an outer surface 5*b*' thereof. Alternatively, or additionally, in the locked state L4 the aligning element 8, such as a wall 8*b* thereof, may engage with the locking groove 6', such as with the inner surface 6*b*'. The aligning element may be straight, such as comprising planar walls 8*a*, 8*b*.

In view of the above, it is clear that the aligning element 8 preferably is absent of any part extending above the locking element 5'. In some embodiments, a width W of the aligning element (see FIGS. 4*a* and 5*c*-5*d*) does not exceed a horizontal space S between the locking element 5' and the, preferably inner surface 6*b*' of the, locking groove 6' in the locked state L4, see FIGS. 3*c*, 5*d*, 6*d*, 7*b*, 11*a* and 11*c*. For example, the width W may be determined by an upper portion 8*e* or a vertical centre 8*f* portion of the aligning element. Thereby, the first edge portion 1*a*" may be essentially freely movable with respect to the aligning element 8 during angling of the fourth edge portion 1*d*'" with respect to the third edge portion 1*c*. The relation between the width W and the space S stated above may be the same for some or, preferably, all of the first and second edge portions in the floor panel assembly, such as for the edge portions 1*a*, 1*b*'.

As illustrated in FIGS. 5*b*-5*d*, 6*a*-6*d* and 7*b*, the aligning element 8 may in some embodiments comprise a flange portion 8*c*, 8*c*' configured to be provided in a recess 18, 18' of the first 1*a*" and/or second 1*b*'" edge portion in the locked state L4. Alternatively, or additionally, as illustrated in FIGS. 6*a*-6*c* and 7*a*, the positioning member 7 may comprise a lug portion 7*h*, 7*h*' configured to be provided in a recess 19, 19' of the fourth edge portion 1*d*" and/or in the fourth edge portion 1*d*'" in the locked state L2 and/or L3.

The recess 18, 18' may be provided in a rear side 1*h* of the third 1" and/or fourth 1" panel(s), preferably in the first 1*a*" and/or second 1*b*" edge portion(s). The flange portion 8*c*, 8*c*' may extend from a lower portion 8*d* of the aligning element 8. Moreover, the recess 19, 19' may be provided in a rear side 1*h* of the third 1" and/or fourth 1'" panel, preferably in the fourth edge portion(s) 1*d*" and/or 1*d*'". The lug portion 7*h*, 7*h*' may extend from a lower portion 7*i* of the positioning member 7. The recess 18 may be provided in the strip 3' and may be sidewardly open, such as under the outer surface 5*b*'. Moreover, the recess 18', 19, 19' may be sidewardly open into the locking groove 6', 10, 10'. The respective recess 18, 18', 19, 19' may extend along the first 1*a*", second 1*b*'", fourth 1*d*" and fourth 1*d*'" edge portions, such that a portion of the aligning element 8 and/or the positioning member 7 may be accommodated therein. For example, they may extend along essentially the entire edge portions.

Figure 5C:
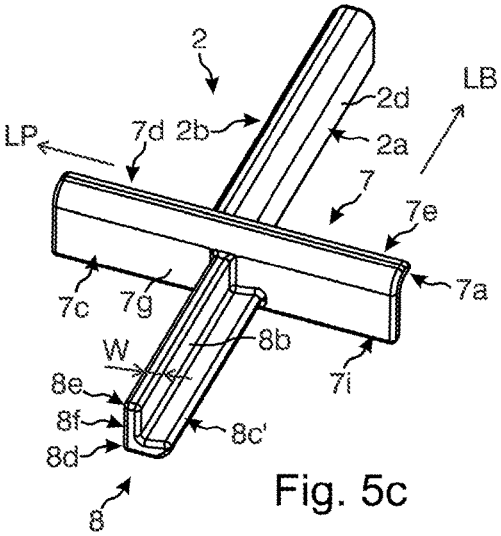
Figure 7A:
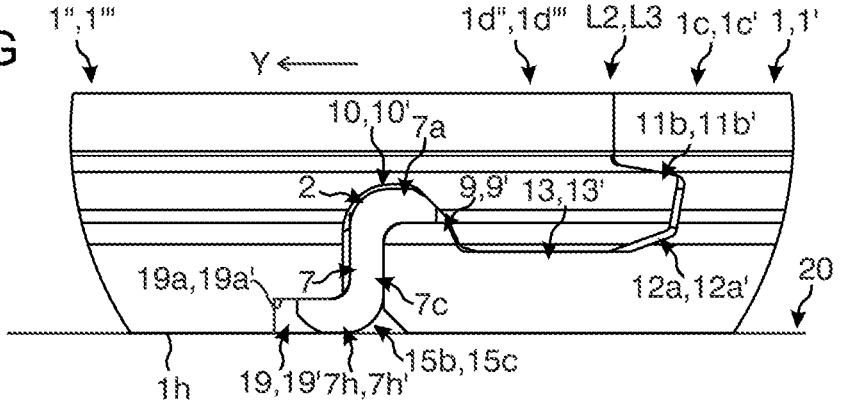
FIG. 7*a* illustrates an embodiment of a floor panel assembly comprising the connecting device in FIGS. 6*a*-6*b* in a locked state L2 and/or L3 along the cross-sectional side views E-E and/or G-G in any of FIGS. 4*e*, and embodiments of a separate panel, e.g., along the cross-sectional side views D'-D' (FIG. 7*c*) and E'-E' (FIG. 7*d*) in of FIG. 5*a*.
Figure 7B:
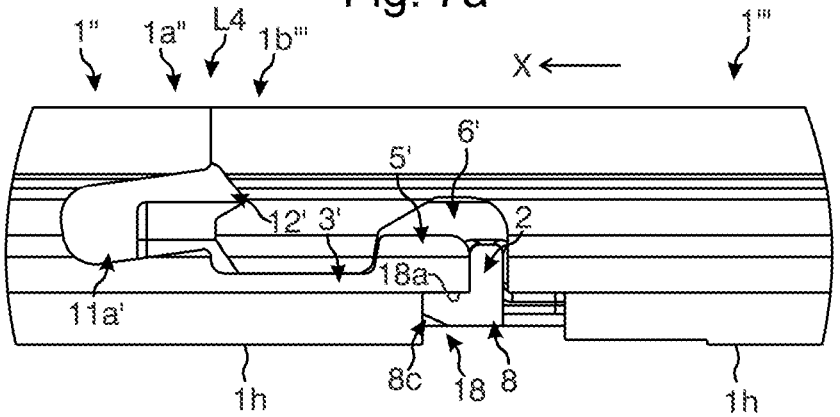

In some embodiments, and as shown in FIG. 7*b*, the aligning element 8 may comprise a flange portion 8*c* facing the first edge portion 1*a*". In some embodiments, and as shown in FIG. 5*b*-5*d*, the aligning element 8 may comprise a flange portion 8*c*' facing the second 1*b*'" edge portion. In yet some embodiments, and as shown in FIG. 6*a*-6*d*, the aligning element 8 may comprise both such flange portions 8*c*, 8*c*'. Optionally, the flange portions 8*c*, 8*c*' may be provided substantially symmetrically with respect to the upper portion 8*e* and/or the vertical centre 8*f* portion, e.g., such that a cross-section of the aligning element is essentially T-shaped.

Furthermore, the lug portion(s) 7*h* and/or 7*h*' may face the fourth 1*d*" and/or 1*d*" edge portion(s). Depending on whether the positioning member 7 comprises an arm portion 7*a* or not, a cross-section thereof may be essentially L-shaped or S-shaped, cf. FIG. 7*a*.

Preferably, the flange portion 8*c*, 8*c*' engages with the recess 18, 18' in the locked state L4, such as with an upper wall 18*a*, 18*a*' thereof. Moreover, the lug portion 7*h*, 7*h*' preferably engages with the recess 19, 19' in the locked state L2 and/or L3, such as with an upper wall 19*a*, 19*a*' thereof.

Generally herein, a vertical distance V1 from the rear side 1*h* of the panel 1, 1' to the upper surface 9*c*, 9*c*' may be the same as a vertical distance V2 from the rear side 1*h* of the panel 1, 1" to the upper surface 5*c*, 5*c*'. Thereby, the arm portion 7*a*, such as the underside 7*b*, may be provided at the same level as the projection 2*b*, such as the underside 2*e*. Also, the locking elements 9, 9' of the third 1*c*, 1*c*', 1*c*", 1*c*'" edge portions may be provided at the same level as the locking elements 5, 5' of the first 1*a*, 1*a*', 1*a*", 1*a*'" edge portions.

Figure 7C:
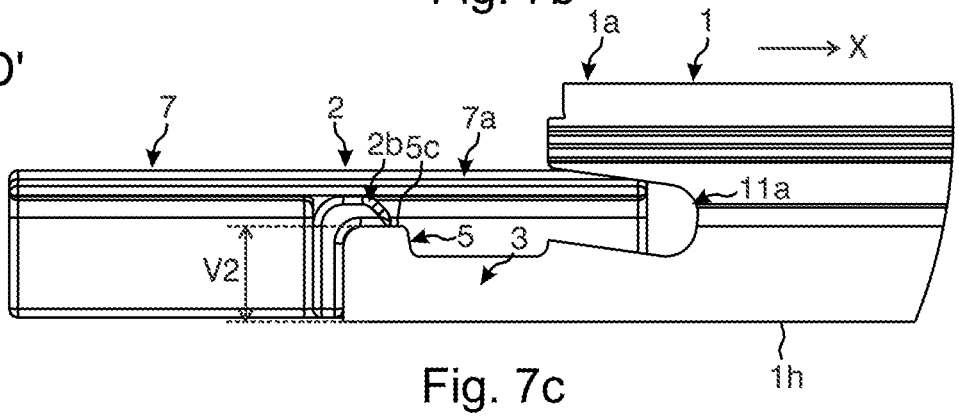
Figure 7D:
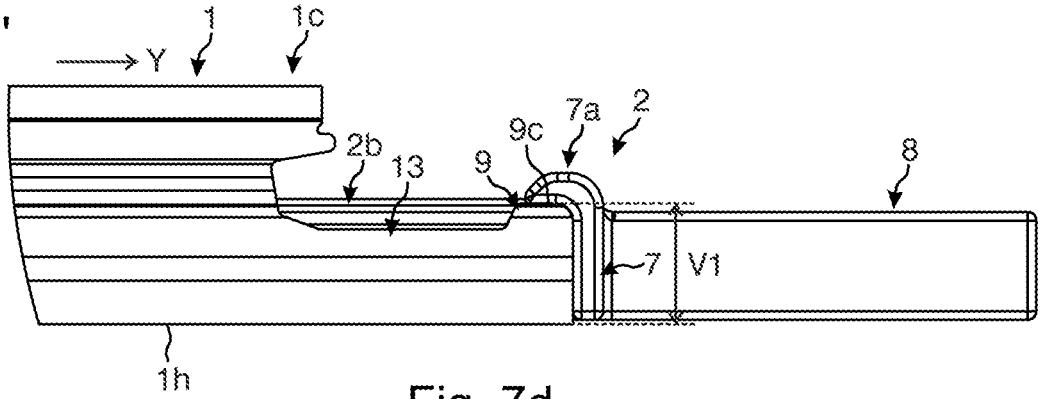

However, in some embodiments, and as shown in FIGS. 7*c*-7*d*, the locking elements 9, 9' of the third 1*c*, 1*c*', 1*c*", 1*c*'" edge portions may extend vertically above the locking elements 5, 5' of the first 1*a*, 1*a*', 1*a*", 1*a*'" edge portions. Hence, V1>V2 and the arm portion 7*a*, such as the underside 7*b*, may be provided vertically above the projection 2*b*, such as the underside 2*e*, as shown in FIGS. 5*b*-5*c*.

In yet some embodiments (not shown), the locking elements 5, 5' of the first 1*a*, 1*a*', 1*a*", 1*a*'" edge portions may extend vertically above the locking elements 9, 9' of the third 1*c*, 1*c*', 1*c*", 1*c*"" edge portions. Thereby, V2>V1 and the arm portion 7*a*, such as the underside 7*b*, may be provided vertically below the projection 2*b*, such as the underside 2*e*.

The connecting device 2 in any of the embodiments herein, such as those in FIGS. 1*a*-1*d*, 2*a*-2*c*, 3*a*-3*d*, 4*a*-4*e*, 5*a*-5*d*, 6*a*-6*d*, 7*a*-7*d*, 8*a*-8*d*, 9*a*-9*e*, 10*a*-10*h* and 11*a*-11*d*, may comprise a sealing member 22, such as a sealing agent or a coating. The sealing member 22 may comprise a wax, a water-repellent agent, or a rubber, such as latex, etc. For example, it may be sprayed or brushed on an enveloping surface 2*f* of the connecting device, cf. FIGS. 4*a* and 6*a*. Preferably, the sealing member 22 covers substantially the entire enveloping surface 2*f*.

In some embodiments, the body portion 2*a* and/or the aligning element 8 may comprise a positioning protrusion 25, 25' configured to cooperate with at least one of the first 1, second 1', third 1", and fourth 1'" panels, see, e.g., FIGS. 10*a*-10*h*. Alternatively, or additionally, the positioning member 7 may comprise a positioning projection 26, 26' configured to cooperate with at least one of the first 1, second 1', third 1", and fourth 1'" panels.

The positioning protrusion 25, 25' may be arranged on one or both sides 2*c*, 2*d* of the body portion 2*a*. It may thereby be configured to cooperate with the first 1 and/or the second 1' panel. Alternatively, or additionally, the positioning protrusion 25, 25' may be arranged on one or both walls 8*a*, 8*b* of the aligning element 8. Thereby, it may be configured to cooperate with the third 1" and/or fourth panel 1'".

The positioning projection 26, 26' may be arranged on one or both sides 7*f*, 7*g* of the base portion 7*c*. It may be arranged on the first positioning portion 7*d* and may thereby be configured to cooperate with the first 1 and/or the third 1" panel. Alternatively, or additionally, it may be arranged on the second positioning portion 7*e* and may thereby be configured to cooperate with the second 1' and/or the fourth 1'" panel.

As shown in, e.g., FIGS. 10*d*-10*g*, the positioning protrusions 25 and 25' and/or positioning projections 26 and 26' may be separated from each other along the longitudinal extension LB and/or LP. Alternatively, and as shown in, e.g., FIG. 10*h*, in some embodiments, the positioning protrusions 25 and 25' arranged on the sides 2*c*, 2*d* and/or the walls 8*a*, 8*b* may be aligned with each other along the longitudinal extension LB. Analogously, the positioning projection 26, 26' on the sides 7*f*, 7*g* may be aligned with each other along the longitudinal extension LP.

The positioning protrusion 25, 25' and/or the positioning projection 26, 26' may extend from the side 2*c*, 2*d*, 7*f*, 7*g* or the wall 8*a*, 8*b* by an extension EP, EB of less than 0.6 mm, such as less than 0.5 mm, for example 0.05-0.6 mm, preferably 0.1-0.5 mm. For example, a more porous material of the core 29 may imply a larger extension EP, EB. The material of any or preferably all of the positioning protrusions 25, 25' and/or positioning projections 26, 26' may be the same as for the body portion 2*a*, the aligning element 8, or the positioning member 7, which for example may be polymer-based material, such as a thermoplastic material, e.g., PLA or PP. In some embodiments, however, the material of any or preferably all of the positioning protrusions 25, 25' and/or positioning projections 26, 26' may be different than the material of the remaining parts of the connecting device. In one example, the material may be a rigid material, for example a thermoplastic material, e.g., PLA or PP. In another example, the material may be a flexible material, such as rubber, silicone, or an adhesive.

Figure 11A:
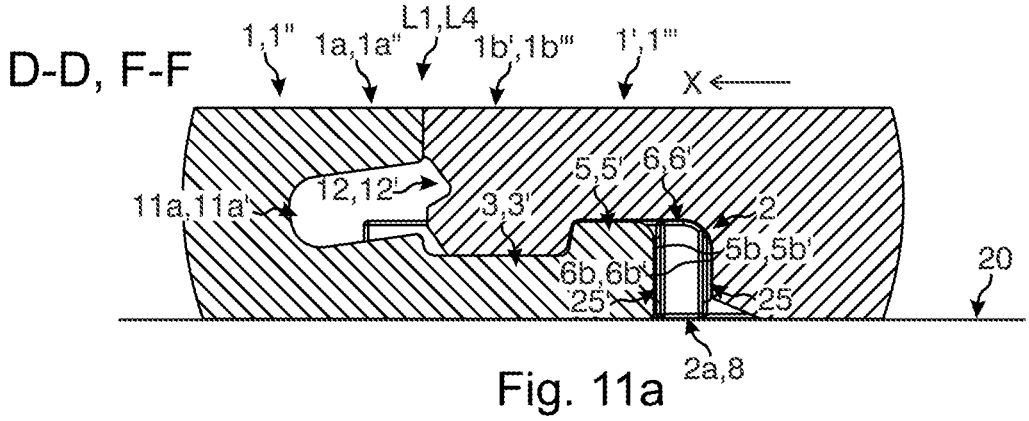
FIGS. 11*a*-11*d* illustrate embodiments of panels and the connecting device in FIGS. 10*d*-10*g* or FIG. 10*h* in a locked state L1 and/or L4 (FIGS. 11*a* and 11*c*) along the cross-sections D-D and/or F-F in any of FIGS. 1*a*-1*b*, 2*a* and 4*d*-4*e*, and in a locked state L2 and/or L3 (FIGS. 11*b* and 11*d*) along the cross-sectional side views E-E and/or G-G in any of FIGS. 1*b*, 2*a* and 4*d*-4*e*.
Figure 11B:
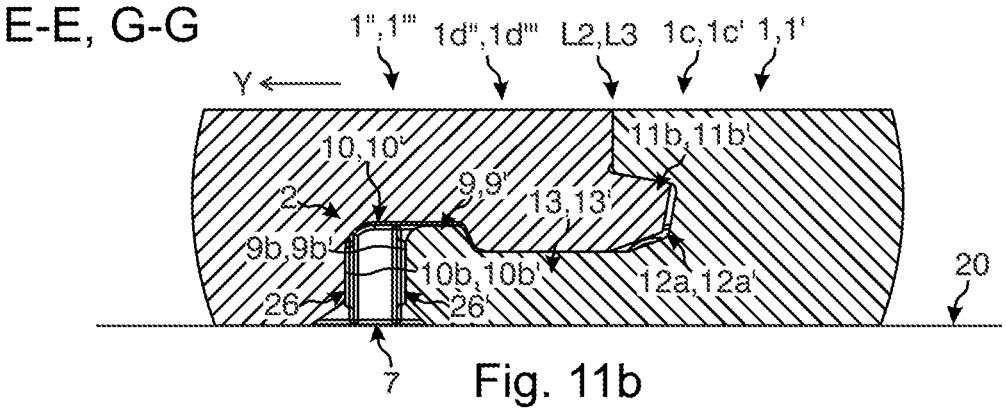
Figure 11C:
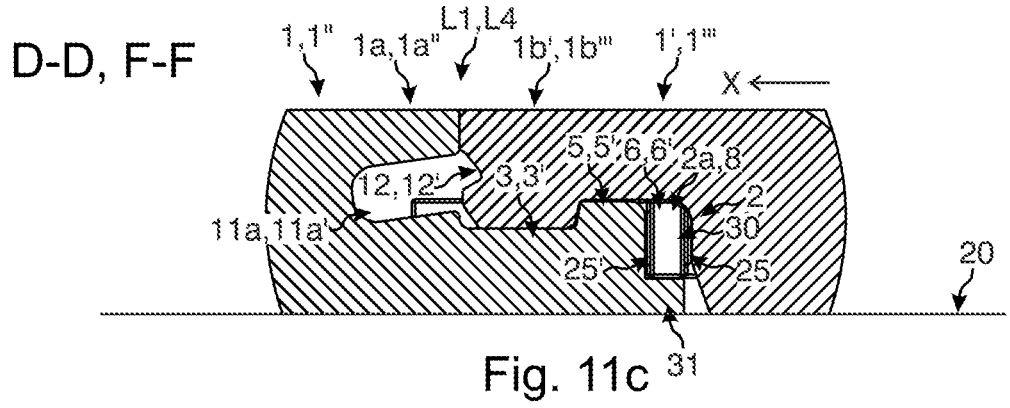

In the locked state L1 and/or L4, the positioning protrusion 25, 25' may cooperate with the outer 5*b*, 5*b*' and/or inner 6*b*, 6*b*' surface(s), optionally with a biasing force (pretension), see, e.g., FIGS. 11*a* and 11*c*. Moreover, in the locked state(s) L2 and/or L3, the positioning projection 26, 26' may cooperate with the outer 9*b*, 9*b*' and/or inner 10*b*, 10*b*' surface(s), optionally with a biasing force, see, e.g., FIGS. 11*b* and 11*d*.

Figure 11D:
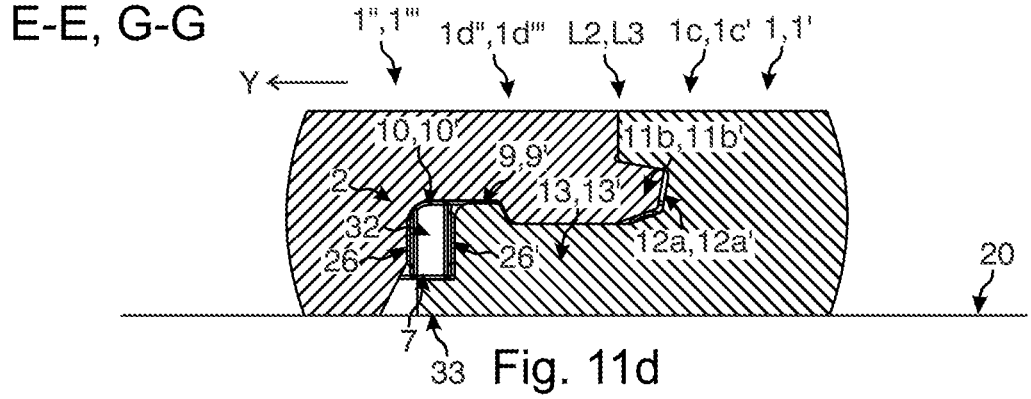

In some embodiments, and as shown in FIG. 11*c*, the connecting device 2, such as the body portion 2*a* and/or the aligning element 8, may be arranged in a cavity 30 provided in the strip 3 and/or 3'. Alternatively, or additionally, and as shown in FIG. 11*d*, the positioning member 7, such as the first 7*d* and/or second 7*e* positioning portion, may be arranged in a cavity 32 provided in the strip 13 and/or 13'. The cavity 30 (32) may be sidewardly open and may be disposed above a shelf 31 (33) arranged in the outer part of the strip 3, 3' (13, 13'). Preferably, the cavity 30 (32) and the shelf 31 (33) extend along the entire edge portion 1*a*, 1*a*" (1*c*, 1*c*').

By means of the cavity 30, 32 the connecting device 2 may be more securely positioned, for example, and especially when, the subfloor 20 is irregular or when a foam is arranged between the subfloor 20 and the panels 1, 1', 1", 1'". It is emphasized that embodiments including cavities 30, 32 are generally included herein, especially without any protrusions 25, 25' and projections 26, 26'.

Figure 8A:
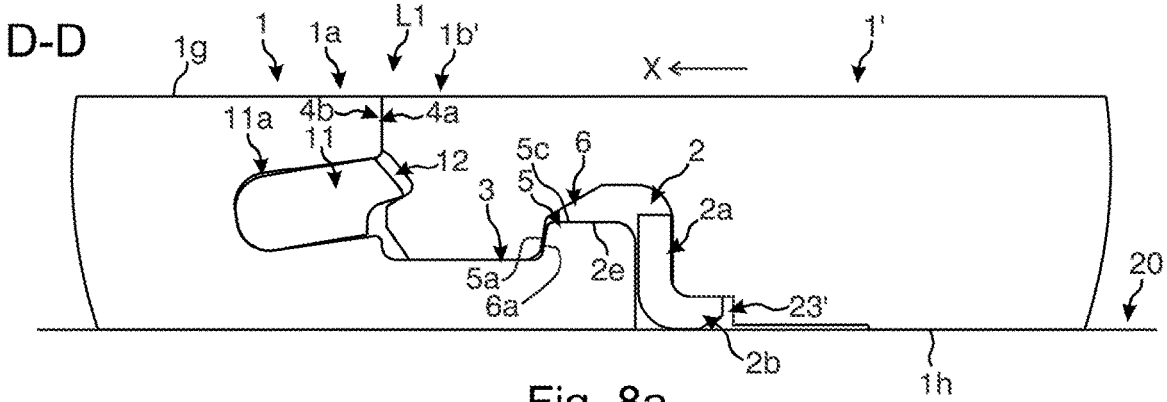
FIGS. 8*a*-8*d* illustrate embodiments of panels in a locked state L1 (FIGS. 8*a* and 8*c*) along the cross-sections D-D in any of FIGS. 1*a*-1*b*, 2*a* and 4*d*-4*e* and embodiments of panels in a locked state L2 and/or L3 (FIGS. 8*b* and 8*d*) along the cross-sectional side views E-E and/or G-G in any of FIGS. 1*b*, 2*a* and 4*d*-4*e*.
Figure 8B:
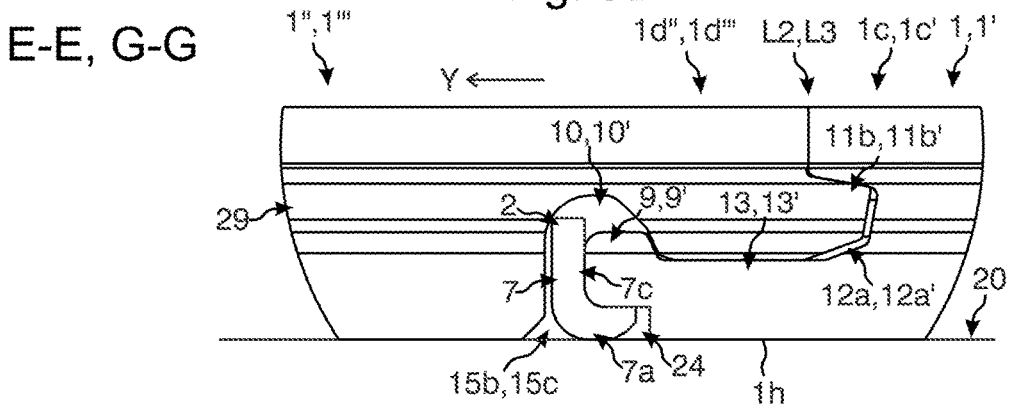

Generally herein, the projection 2*b* and/or the arm portion 7*a* may be disposed in an upper section 27 of the connecting device 2. In some embodiments, however, the connecting device 2, such as in any of those in FIGS. 4*a*, 4*c*, 5*c*, 6*a*-6*b* and 7*a*-7*d*, may be turned upside-down in the locked state L1, and optionally in the locked state(s) L2 and/or L3 and/or L4. Thereby, the projection 2*b* and/or arm portion 7*a* may be disposed in a lower section 28 of the connecting device 2, see, e.g., FIG. 4*a* rotated by 180° around an axis extending along the longitudinal extension LB (see arrow R). Such embodiments are shown in, e.g., FIGS. 8*a*-8*d*. As shown in FIG. 8*a*, the projection 2*b* may be provided in a projection channel 23' of the second edge portion 1*b'* in the locked state L1. Alternatively, or additionally, the arm portion 7*a* may be provided in an arm channel 24 of the first 1*c* and/or second 1*c'* edge portion(s) in the locked state(s) L2 and/or L3, see FIG. 8*b*. It is noted that the aligning element 8 in any of FIGS. 8*a*-8*d*, may be embodied as in, e.g., FIGS. 3*c*, 4*a*-4*c*, 5*c* or 6*a*-6*b*.

Figure 8C:
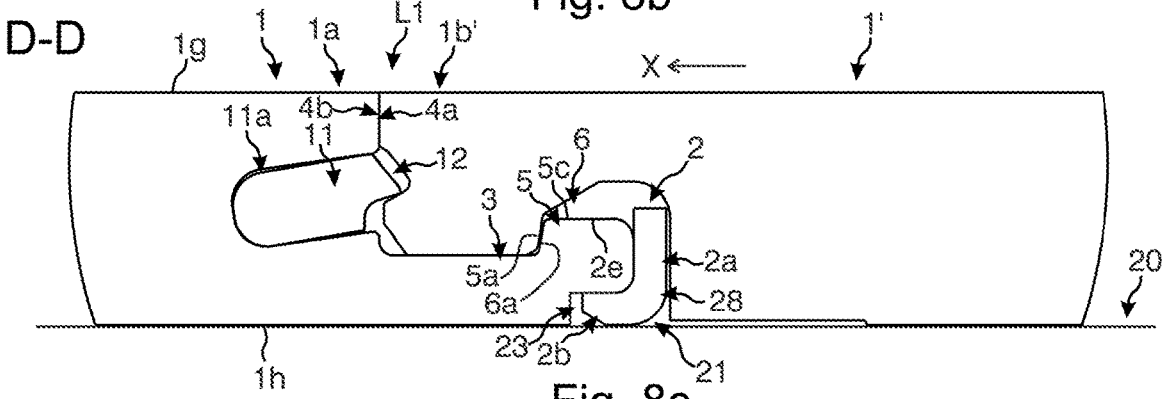
Figure 8D:
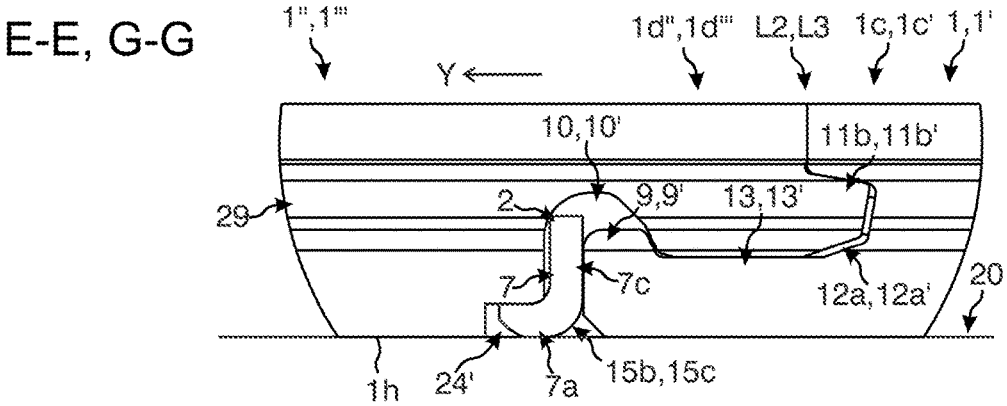
Figure 9A:
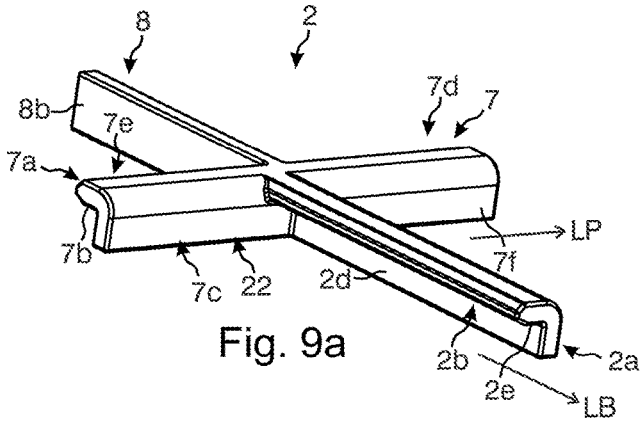
FIGS. 9*a*-9*e* illustrate in a perspective view (FIG. 9*a*), a bottom view (FIG. 9*b*) and a side view (FIG. 9*c*) an embodiment of a connecting device and related embodiments of panels in a locked state L1 (FIG. 9*d*) along the cross-sections D-D in any of FIGS. 1*a*-1*b*, 2*a* and 4*d*-4*e*, and in a locked state L2 and/or L3 (FIG. 9*e*) along the cross-sectional side views E-E and/or G-G in any of FIGS. 1*b*, 2*a* and 4*d*-4*e*.
Figure 9B:
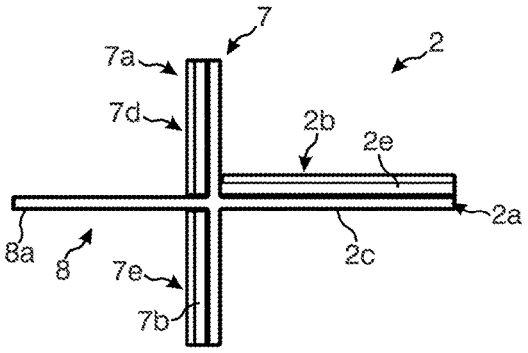
Figure 9C:
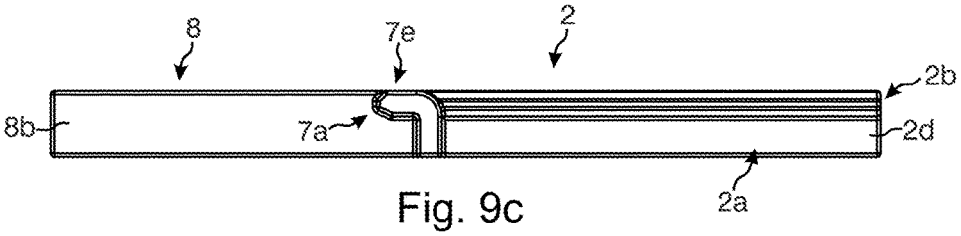
Figure 9D:
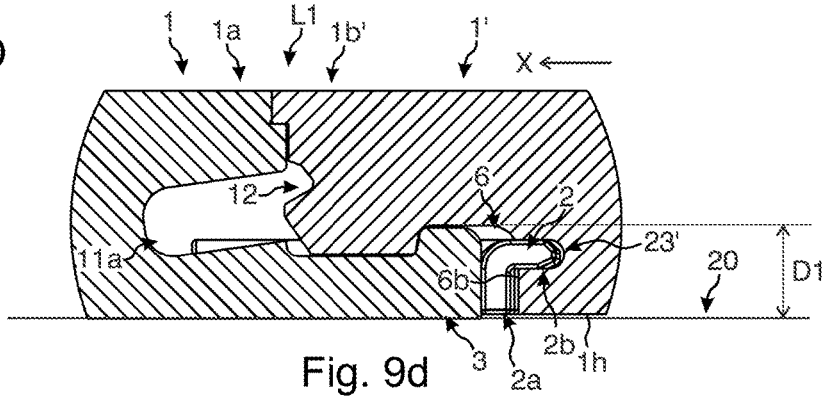
Figure 9E:
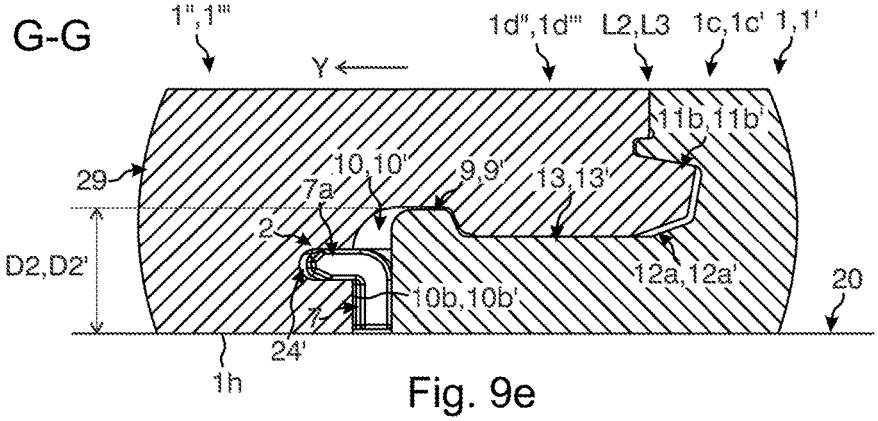
Figure 10A:
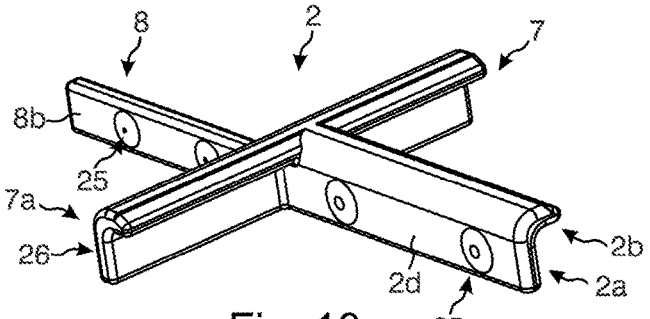
FIGS. 10*a*-10*c* illustrate in a perspective view (FIG. 10*a*), a side view (FIG. 10*b*) and a front view (FIG. 10*c*) an embodiment of a connecting device.
Figure 10B:
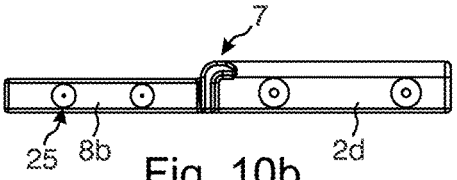
Figure 10C:
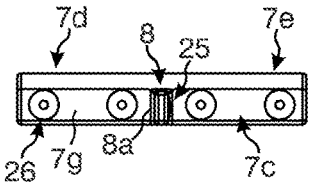
Figure 10D:
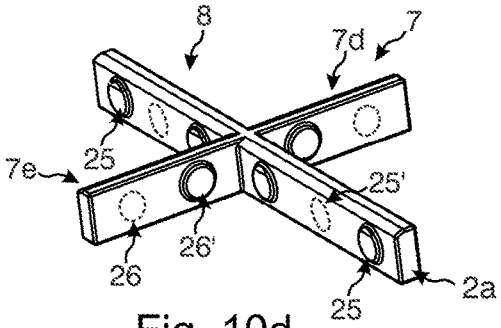
FIGS. 10*d*-10*g* illustrate in a perspective view (FIG. 10*d*), a side view (FIG. 10*e*), a front view (FIG. 10*f*), and a top view (FIG. 10*g*) an embodiment of a connecting device.
Figure 10E:
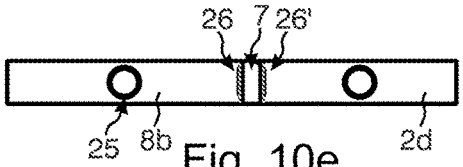
Figure 10F:
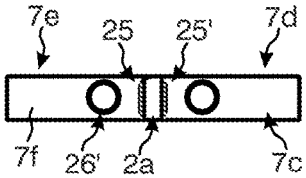
Figure 10G:
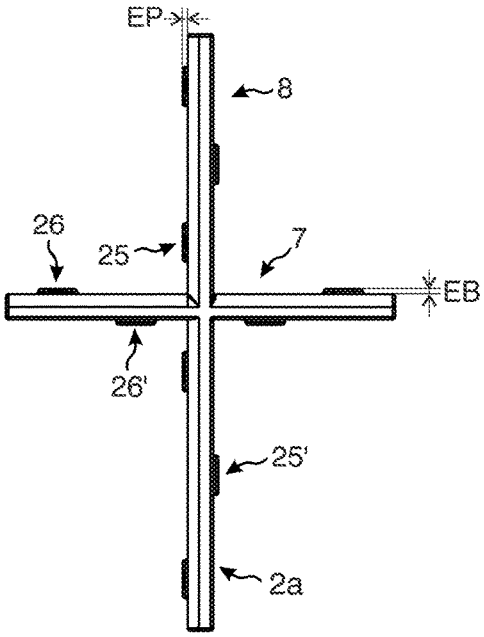
Figure 10H:
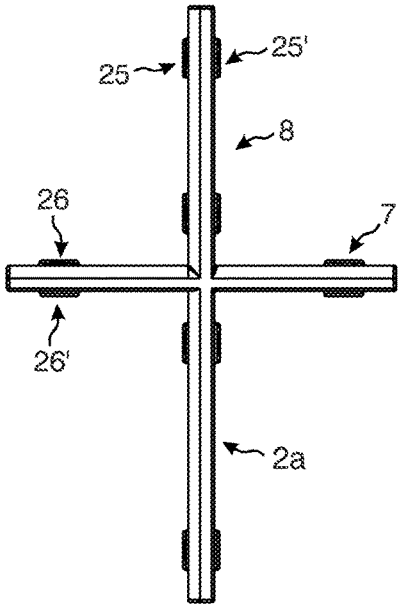
FIG. 10*h* illustrates an embodiment of a connecting device in a top view.

Other embodiments wherein the connecting device 2 is turned upside-down are equally conceivable. For example, a mirror version of the connecting device 2 in FIG. 4*a* may be utilized. Thereby, as shown in FIG. 8*c*, the projection 2*b* may be provided in a projection channel 23 of the first edge portion 1*a* in the locked state L1. Alternatively, or additionally, the arm portion 7*a* may be provided in an arm channel 24' of the third 1*d"* and/or fourth 1*d'"* edge portion(s) in the locked state(s) L2 and/or L3, see FIG. 8*d*.

In some embodiments, FIGS. 8*a* and 8*d* or FIGS. 8*b* and 8*c* may be combined.

Preferably, the projection channel 23 (23') is provided in a rear side 1*h* of the first panel 1 (second panel 1') and/or in the outer surface 5*b* (6*b*) of the first edge portion 1*a* (second edge portion 1*b'*). Moreover, the arm channel 24 (24') preferably is provided in a rear side 1*h* of the first 1 and/or second 1' (third 1" and/or fourth 1'") panel(s) and/or in the outer surface 9*b*, 9*b'* (inner surface 10*b*, 10*b'*) of the first 1*c* and/or second 1*c'* (third 1*d"* and/or fourth 1*d'"*) edge portion (s).

In some embodiments, and as shown in, e.g., FIGS. 9*a*-9*e*, the projection 2*b* and/or the arm portion 7*a* may extend in horizontal directions opposite to those in, e.g., FIGS. 4*a*, 4*c*, 5*c* and 6*a*-6*b*. The projection 2*b* may be provided in a projection channel 23' of the second edge portion 1*b'* in the locked state L1. The projection channel 23' may be provided in the locking groove 6, such as in the inner surface 6*b*, preferably being vertically spaced from the rear side 1*h*. Alternatively, or additionally, the arm portion 7*a* may be provided in an arm channel 24' of the third 1*d"* and/or fourth 1*d"* edge portion(s) in the locked state(s) L2 and/or L3. The arm channel 24' may be provided in the locking groove 10 and/or 10', such as in the inner surface(s) 10*b* and/or 10*b'*, preferably being vertically spaced from the rear side 1*h*. By means of the embodiments in FIGS. 9*a*-9*e*, a smaller depth D1, D2, D2' of the locking groove 6, 10, 10' may be needed for housing the connecting device comprising a projection 2*b* and/or an arm portion 7*a*. Thereby, a stability and/or a durability of the panels, such as in a Castor chair test, may increase.

Figure 4D:
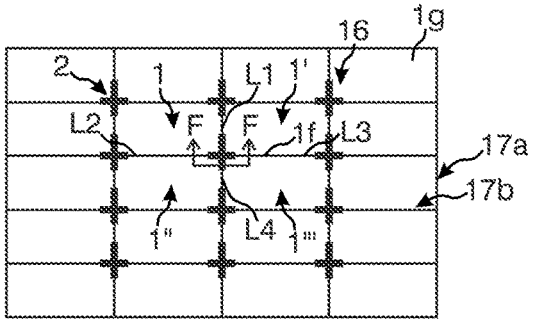
Figure 4E:
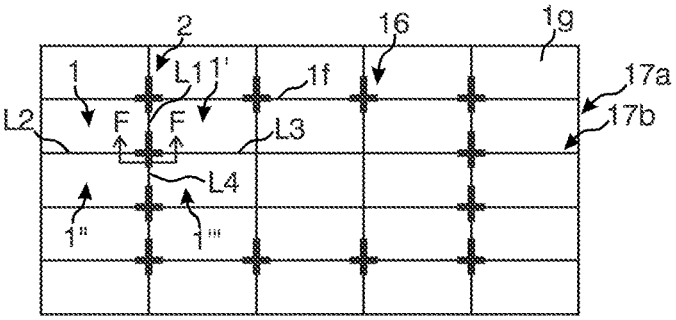

The floor panel assembly may comprise a plurality of connecting devices 2. In a first example, and as shown in FIG. 4*d*, there may be a connecting device 2 provided at each inner junction 16 of the floor panel assembly. In a second example, and as shown in FIG. 4*e*, there may be connecting devices 2 provided, preferably only, at the outermost junctions 16.

The panels 1, 1', 1", 1'" in the floor panel assembly may comprise a decorative joint portion 17*a*, 17*b* along at least one, preferably all, of their edge portions, see, e.g., FIGS. 1*c*-1*d*, 2*b* and 4*d*-4*e*. Non-limiting embodiments of such decorative joint portions 17*a*, 17*b* are described in WO 03/078761, page 18, line 15 to page 21, line 15 and FIGS. 4*b*, 5*c*, 6*a*-6*c* and 7*a*-7*c*, whose content hereby is incorporated by reference.

Aspects of the disclosure have mainly been described above with reference to a few embodiments. However, as is readily appreciated by a person skilled in the art, other embodiments than the ones disclosed above are equally possible within the scope of the disclosure. For example, embodiments in which the longitudinal extensions LP and LB of the connecting device 2 essentially are equal are equally conceivable. In addition, embodiments of the floor panel assembly comprising floor panels described herein are equally conceivable for a corresponding wall panel assembly comprising wall panels.

EXAMPLE

Samples of a floor panel assembly comprising a plurality of sample panels and a sample connecting device with a positioning member and an aligning element were tested in Castor chair tests along with reference sample panels without any connecting device arranged thereto. It was found that the sample panels with the sample connecting device were more securely interlocked to each other as compared to reference sample panels without any connecting device arranged thereto, since the relative horizontal displacements between the sample panels with the sample connecting device after the tests were smaller than the horizontal displacements between the sample panels without the connecting device.

The invention claimed is:

1. A floor panel assembly comprising a first panel and a second panel, wherein a first edge portion of the first panel comprises a strip extending horizontally beyond an upper portion of the first edge portion, the strip comprising an upwardly extending locking element, and wherein a second edge portion of the second panel comprises a downwardly open locking groove configured to cooperate with said upwardly extending locking element for horizontally locking the first and second edge portions to each other, the floor panel assembly further comprising a connecting device configured to be at least partially arranged in the downwardly open locking groove in a locked state of the first and second edge portions, wherein the connecting device comprises a positioning member configured to extend along a third edge portion of the first panel in said locked state, said first and third edge portions joining each other at a corner portion of the first panel, wherein the third edge portion of the first panel includes a third edge surface extending upward from a rear side of the first panel, and wherein the positioning member of the connecting device is configured to contact the third edge surface along the third edge portion of the first panel in said locked state.

2. The floor panel assembly according to claim 1, wherein the positioning member is further configured to extend along a third edge portion of the second panel in said locked state, said second and third edge portions joining each other at a corner portion of the second panel.

3. The floor panel assembly according to claim 1, wherein the positioning member comprises an arm portion configured to extend in said locked state at least partially above an upwardly extending locking element of the third edge portion of the first panel and/or an upwardly extending locking element of a third edge portion of the second panel.

4. The floor panel assembly according to claim 1, wherein an upwardly extending locking element of the third edge portion of the first panel and/or an upwardly extending locking element of the third edge portion of the second panel extend(s) vertically above the upwardly extending locking element of the first edge portion of the first panel.

5. The floor panel assembly according to claim 1, wherein the upwardly extending locking element of the first edge portion of the first panel extends vertically above an upwardly extending locking element of the third edge portion of the first panel and/or an upwardly extending locking element of the third edge portion of the second panel.

6. The floor panel assembly according to claim 1, wherein a body portion of the connecting device is configured to be arranged in the downwardly open locking groove horizontally outward of the upwardly extending locking element in said locked state, and wherein a projection is configured to extend from the body portion at least partially above the upwardly extending locking element in said locked state.

7. The floor panel assembly according to claim 1, wherein the connecting device further comprises an aligning element configured to extend along a first edge portion of a third panel of the floor panel assembly in said locked state of the first and second edge portions and in a locked state of the third edge portion of the first panel and a fourth edge portion of the third panel.

8. The floor panel assembly according to claim 7, wherein the aligning element is arranged horizontally outward of the first edge portion of the third panel in said locked state of the first and second edge portions and in said locked state of the third and fourth edge portions.

9. The floor panel assembly according to claim 7, wherein the aligning element comprises a flange portion configured to be provided in a recess of the first edge portion of the third panel and/or in a second edge portion of a fourth panel in a locked state of a first edge portion of the third panel and a second edge portion of the fourth panel.

10. The floor panel assembly according to claim 9, wherein the flange portion extends from a lower portion of the aligning element and the recess is provided in a rear side of the third and/or fourth panel.

11. The floor panel assembly according to claim 1, wherein the positioning member comprises a lug portion configured to be provided in a recess of a fourth edge portion of a third panel and/or in a fourth edge portion of a fourth panel in a locked state of the third edge portion of the first panel and the fourth edge portion of the third panel and/or in a locked state of a third edge portion of the second panel and the fourth edge portion of the fourth panel.

12. The floor panel assembly according to claim 11, wherein the lug portion extends from a lower portion of the positioning member and the recess is provided in a rear side of the third and/or fourth panel.

13. The floor panel assembly according to claim 1, further comprising a tongue and a tongue groove for vertical locking of the first and second edge portions.

14. The floor panel assembly according to claim 13, wherein the tongue is a separate tongue.

15. The floor panel assembly according to claim 1, wherein the connecting device comprises a polymer-based material.

16. The floor panel assembly according to claim 1, wherein the first and second edge portions are configured to be assembled to each other by a relative essentially vertical displacement of the first and second panels against each other, and/or wherein the third edge portion of the first panel and a fourth edge portion of a third panel are configured to be assembled to each other by angling of the third and first panels relative to each other.

17. The floor panel assembly according to claim 1, wherein a body portion and/or an aligning element of the connecting device comprise(s) a positioning protrusion configured to cooperate with at least one panel of the floor panel assembly.

18. The floor panel assembly according to claim 1, wherein the positioning member comprises a positioning projection configured to cooperate with at least one panel of the floor panel assembly.

19. The floor panel assembly according to claim 1, further comprising a third panel and a fourth panel, wherein the first, second, third and fourth panels are configured to be assembled to each other such that a four-way junction is formed at the corner portion of the first panel and respective corner portions of the second, third and fourth panels.

20. A floor panel assembly comprising a first panel and a second panel, wherein a first edge portion of the first panel comprises a strip extending horizontally beyond an upper portion of the first edge portion, the strip comprising an upwardly extending locking element, and wherein a second edge portion of the second panel comprises a downwardly open locking groove configured to cooperate with said upwardly extending locking element for horizontally locking the first and second edge portions to each other, the floor panel assembly further comprising a connecting device configured to be at least partially arranged in the downwardly open locking groove in a locked state of the first and second edge portions, wherein the connecting device comprises a positioning member configured to extend along a third edge portion of the first panel in said locked state, said first and third edge portions joining each other at a corner portion of the first panel, wherein the positioning member is configured to counteract a relative horizontal displacement of one of the first and second panels with respect to the other panel in a direction along the first and second edge portions, by the positioning member abutting an upwardly extending surface of the third edge portion of the first panel and an upwardly extending surface of a third edge portion of the second panel in said locked state.

21. A floor panel assembly comprising a first panel and a second panel, wherein a first edge portion of the first panel comprises a strip extending horizontally beyond an upper portion of the first edge portion, the strip comprising an upwardly extending locking element, and wherein a second edge portion of the second panel comprises a downwardly open locking groove configured to cooperate with said upwardly extending locking element for horizontally locking the first and second edge portions to each other, the floor panel assembly further comprising a connecting device configured to be at least partially arranged in the downwardly open locking groove in a locked state of the first and second edge portions, wherein the connecting device comprises a positioning member configured to extend along a third edge portion of the first panel in said locked state, said first and third edge portions joining each other at a corner portion of the first panel, wherein, in said locked state, a lowermost surface of the connecting device is vertically higher than a lowermost surface of the first panel and a lowermost surface of the second panel.

* * * * *